US005670284A

United States Patent [19]

Kishi et al.

[11] Patent Number: 5,670,284

[45] Date of Patent: Sep. 23, 1997

[54] ELECTROPHOTOGRAPHIC PHOTOCONDUCTOR

[75] Inventors: Hiroyuki Kishi; Toshio Fukagai; Kiyoshi Taniguchi, all of Numazu; Tomohiro Inoue, Sagamihara, all of Japan

[73] Assignee: Ricoh Company, Ltd., Tokyo, Japan

[21] Appl. No.: 365,194

[22] Filed: Dec. 28, 1994

[30] Foreign Application Priority Data

Dec. 28, 1993 [JP] Japan ..... 5-336282
Dec. 20, 1994 [JP] Japan ..... 6-316448

[51] Int. Cl.[6] ..... G03G 5/047; G03G 5/14

[52] U.S. Cl. ..... 430/58; 430/60; 430/64; 430/65

[58] Field of Search ..... 430/58, 59, 64, 430/65, 60

[56] References Cited

U.S. PATENT DOCUMENTS 4,599,286 7/1986 Limburg et al. ..... 430/59
4,822,705 4/1989 Fukagai et al. ..... 430/64
4,863,822 9/1989 Fukagai et al. ..... 430/58
4,888,262 12/1989 Tamaki et al. ..... 430/58
5,286,588 2/1994 Suzuki ..... 430/58
5,427,880 6/1995 Tamura et al. ..... 430/59

OTHER PUBLICATIONS

Diamond, Arthur S., editor, *Handbook of Imaging Systems.* New York: Marcel–Dekker, Inc., 1991, pp. 427–439 & 443.

*Primary Examiner*—Christopher D. Rodee
*Attorney, Agent, or Firm*—Oblon, Spivak, McClelland, Maier & Neustadt, P.C.

[57] ABSTRACT

A layered type electrophotographic photoconductor includes an electroconductive support; and a photoconductive layer formed thereon, which photoconductive layer contains a charge generation layer and a charge transport layer, which are overlaid, with the charge generation layer containing a polyalkylene glycol and/or a derivative thereof and/or a crown ether, and the charge transport layer containing an antioxidant. Alternatively, an undercoat layer may be interposed between the electroconductive support and the photoconductive layer, with the undercoat layer containing a polyalkylene glycol and/or a derivative thereof and/or a crown ether, and the charge transport layer containing an antioxidant.

9 Claims, No Drawings

ELECTROPHOTOGRAPHIC PHOTOCONDUCTOR

BACKGROUND OF THE INVENTION

1. Field of the Invention

The present invention relates to a layered type electrophotographic photoconductor comprising an electroconductive support and a photoconductive layer formed thereon, which photoconductive layer comprising a charge generation layer and a charge transport layer, which are overlaid, with the charge generation layer comprising a polyalkylene glycol and/or a derivative thereof and/or a crown ether, and the charge transport layer comprising an antioxidant.

2. Discussion of Background

Conventionally, inorganic photoconductive materials such as selenium, selenium alloys, zinc oxide, cadmium sulfide have been employed as the materials for electrophotographic photoconductors. Recently, however, varieties of organic photoconductors comprising organic photoconductive materials are also employed because of the advantages of low cost, high productivity, and non-pollution problems over inorganic photoconductive materials.

As such organic photoconductors, photoconductor comprising a photoconductive resin, a representative example of which is polyvinycarbazole (PVK); photoconductors comprising a charge-transfer complex type photoconductive material, a representative example of which is PVK-TNF (2,4,7-trinitrofluoroenone); photoconductors comprising a pigment-dispersed type photoconductive material, a representative example of which is a phthalocyanine-binder type photoconductive material; and function-separated type photoconductors comprising a charge generating material and a charge transporting material in combination.

Of these organic photoconductor, the function-separated type photoconductors attract particular attention.

However, the function-separation type photoconductors have the shortcomings that chargeability is low, charge-retention performance is poor, that is, dark decay is large, the deterioration of such chargeability and charge-retention performance during repeated use thereof is great, which cause non-uniform image density, lowering of image density, and in reversal development, toner deposition of the background of images takes place.

The mechanism of the occurrence of the above-mentioned deterioration of the function-separated type photoconductors has not yet been clarified sufficiently, but it is considered that the passing of electric charges through the photoconductors and the generation of oxidizing gases while in repeated use cause the above-mentioned deterioration of the function-separated type photoconductors.

In order to improve the electric characteristics of such photoconductors, including the chargeability thereof, the addition of additives to the photoconductive layer, an undercoat layer and a protective layer for the photoconductive layer has been proposed.

For example, Japanese Laid-Open Patent Applications Nos. 61-156052, 62-265666, 64-40835 and 1-200261 propose additives to be added to the charge transport layer; Japanese Laid-Open Patent Applications Nos. 57-122444, 58-120260, 62-105151, 62-223761, 62-234164, 1-197759 and 3-110566 propose additives to be added to the photoconductive layer; Japanese Laid-Open Patent Applications Nos. 63-243945, 63-220151 and 63-220153 propose additives to be added to the charge generation layer; Japanese Laid-Open Patent Applications Nos. 63-206762, 63-221353, 64-571, 2-79859, 2-300758, 3-23464 and 4-177359 propose additives to be added to the undercoat layers; and Japanese Laid-Open Patent Application Nos. 59-136744 and 63-291063 propose additives to be added to the protective layer.

However, when additives are added to the protective layer and charge transport layer in an attempt to improve the speed of the chargeability and the durability of the photoconductors, the residual potential of the photoconductors tends to be increased during the repeated use thereof as side effects of the additives.

When additives are added to the charge generation layer and undercoat layer, the electrostatic characteristics of the photoconductors are not so much impaired in comparison with the case when additives are added to the protective layer and/or the charge transport layer. However, the addition of additives to the charge generation layer and undercoat layer does not improve the speed of the chargeability and the durability of the photoconductors sufficiently for use in practice.

When additives are added to the charge generation and undercoat layer, different problems are also caused. Namely, when a charge generation layer formation liquid is used in an immersion type coating method, the liquid is constantly circulated between a coating chamber and a liquid reservoir, so that if the liquid is preserved in such a circulating state for a long period of time, the liquid is caused to deteriorate in contact with oxidizing gases contained in air, although there will be no problems if the liquid is hermetically sealed when preserved.

If the charge generation layer formation liquid in such a deteriorating state is used for the formation of a charge generation layer, the chargeability obtained is extremely poor.

SUMMARY OF THE INVENTION

It is therefore a first object of the present invention to provide an electrophotographic photoconductor with a chargeability which is not lowered, a minimum increase in the residual potential thereof, and stable electrophotographic characteristics, even when used repeatedly by repeating charging and exposure steps.

A second object of the present invention is to provide an electrophotographic photoconductor with stable electrophotographic characteristics even when a charge transport layer formation liquid for fabricating the electrophotographic photoconductor is used over a long period of time.

The first object of the present invention can be achieved by a layered type electrophotographic photoconductor comprising an electroconductive support and a photoconductive layer formed thereof, which photoconductive layer comprises a charge generation layer and a charge transport layer, which are overlaid, with the charge generation layer comprising a polyalkylene glycol and/or a derivative thereof and/or a crown ether, and the charge transport layer comprising an antioxidant.

Alternatively, the first object of the present invention can be achieved by a layered type electrophotographic photoconductor comprising an electroconductive support and a photoconductive layer formed thereof, which photoconductive layer comprises a charge generation layer and a charge transport layer, which are overlaid, and an undercoat layer which is interposed between the electroconductive support and the photoconductive layer, with the undercoat layer comprising a polyalkylene glycol and/or a derivative thereof and/or a crown ether, and the charge transport layer comprising an antioxidant.

The second object of the present invention can be achieved by a charge transport layer formation liquid comprising an antioxidant.

DESCRIPTION OF THE PREFERRED EMBODIMENTS

An electrophotographic photoconductor of the present invention is a layered type electrophotographic photoconductor comprising an electroconductive support and a photoconductive layer formed thereof, which photoconductive layer comprises a charge generation layer and a charge transport layer, which are overlaid, with the charge generation layer comprising a polyalkylene glycol and/or a derivative thereof and/or a crown ether, and the charge transport layer comprising an antioxidant.

Another electrophotographic photoconductor of the present invention is a layered type electrophotographic photoconductor comprising an electroconductive support and a photoconductive layer formed thereon, which photoconductive layer comprises a charge generation layer and a charge transport layer, which are overlaid, and an undercoat layer which is interposed between the electroconductive support and the photoconductive layer, with the undercoat layer comprising a polyalkylene glycol and/or a derivative thereof and/or a crown ether, and the charge transport layer comprising an antioxidant.

Examples of the polyalkylene glycol and a derivative thereof for use in the present invention are as follows, but not limited to the following:

Specific examples of the polyalkylene glycol are polyethylene glycol, polypropylene glycol, and polybutylene glycol. A copolymer of ethylene glycol and i-propylene glycol can also employed in the present invention.

It is preferable that the polyethylene glycol for use in the present invention have a molecular weight in a range of 60 to 5,000,000, more preferably in a range of 200 to 50,000 that the polypropylene glycol for use in the present invention have a molecular weight of 70 to 10,000 more preferably in a range of 500 to 5,000 that the polybutylene glycol have a molecular weight of 90 to 4,000, more preferably in a range of 90 to 3,000, and that the copolymer of ethylene glycol and i-propylene glycol have a molecular weight of 200 to 100,000, more preferably in a range of 500 to 50,000.

As the derivative of the polyalkylene glycol, for instance, esters and ethers thereof are preferable for use in the present invention.

Mono- or di-esters of the polyalkylene glycol for use in the present invention are respectively represented by the following formulae (I) and (II):

$$R^1COO[(CH_2)_mO]_nH \quad (I)$$

$$R^1COO[(CH_2)_mO]_nOCR^2 \quad (II)$$

wherein m is an integer of 2 to 4; n is an integer of 1 to 30 (average addition mole number), $R^1$ and $R^2$ each represents an alkyl group having 1 to 30 carbon atoms, or an alkenyl group, preferably an alkyl group having 10 to 20 carbon atoms, or an alkenyl group.

Specific examples of the above mono- or di-esters of the polyalkylene glycol are polyethylene glycol monostearate, polyethylene glycol monooleate, polyethylene glycol distearate, polyethylene glycol dilaurate and polyethylene glycol dioleate.

Polyalkylene glycol monoethers for use in the present invention are represented by the following formula (III):

$$R—O[(CH_2)_mO]_nH \quad (III)$$

wherein m is an integer of 2 to 4; R represents an alkyl group having 1 to 30 carbon atoms, preferably an alkyl group having 10 to 20 carbon atoms, or an unsubstituted or substituted aryl group, preferably a phenyl group substituted with an alkyl group having 1 to 20 carbon atoms; and n is an integer of 1 or more, preferably an integer of 1 to 100, which is an average addition mole number.

Specific example of the above polyalkylene glycol monoether are polyoxyethylene nonyl phenyl ether, polyoxyethylene lauryl ether, and polyoxyethylene octyl phenyl ether.

It is preferable that the crown ether for use in the present invention have a ring structure with 3 to 8 carbon atoms. Specific examples of the crown ether for use in the present invention are as follows, but not limited to the following:

benzo-9-crown-3-ether,

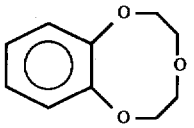

12-crown-4-ether,

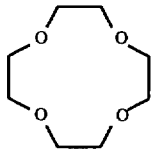

perhydrobenzo-18-crown-6-ether,

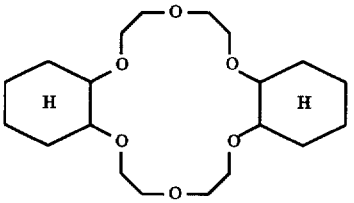

tetrabenzo-24-crown-8-ether,

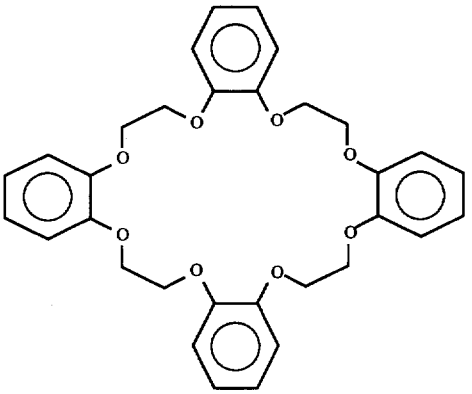

-continued 18-crown-6-ether,

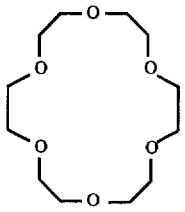

dibenzo-18-crown-6-ether,

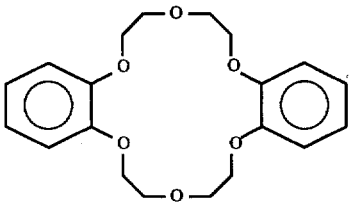

dibenzo-24-crown-8-ether,

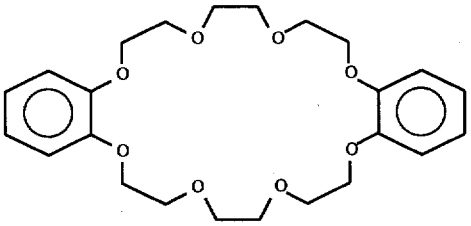

dicyclohexano-24-crown-8-ether,

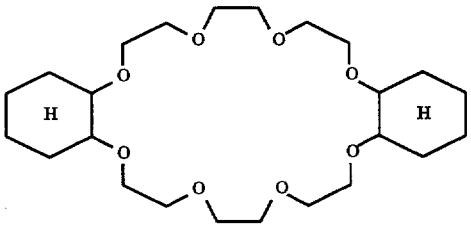

tribenzo-18-crown-6-ether,

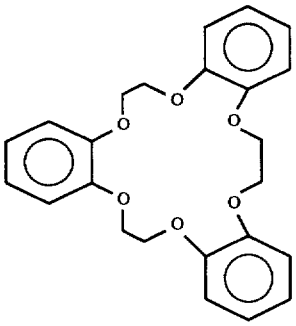

-continued 15-crown-5-ether,

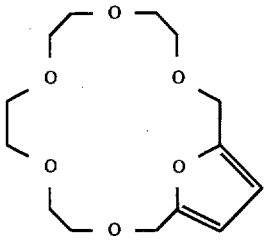

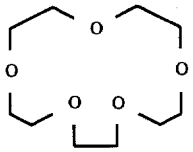

21-crown-7-ether,

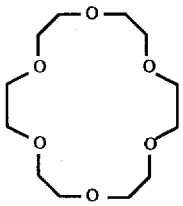

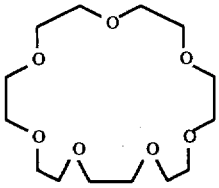

The above-mentioned polyalkylene glycols and derivatives thereof and/or the crown ethers can be used alone or in combination.

When the polyalkylene glycol and/or a derivative thereof and/or crown ether is employed in the charge generation layer, the ratio by weight thereof to 1 part by weight of a charge generating material is 1/1000 to 2/1 parts by weight, preferably 1/100 to 1/1, although the ratio varies depending upon the charge generating material or a binder agent employed.

When the above ratio is less than 1/1000, the effects of the polyalkylene glycol and/or a derivative thereof and/or crown ether are not sufficient, while when the ratio exceeds 2/1, the residual potential of the photoconductor tends to be increased and therefore the photosensitivity of the photoconductor considerably decreases.

When the polyalkylene glycol and/or a derivative thereof and/or crown ether is employed in the undercoat layer, the ratio by weight thereof to 1 part by weight of a resin employed in the undercoat layer is 1/1000 to 1/1 parts by weight, preferably 1/100 to 1/2.

When the above ratio is less than 1/1000, the effects of the polyalkylene glycol and/or a derivative thereof and/or crown ether are not sufficient, while when the ratio exceeds 1/1, the residual potential of the photoconductor tends to be increased and therefore the photosensitivity of the photoconductor considerably decreases.

As the antioxidant for use in the present invention, phenolic compounds, organic phosphorus compounds, organic sulfur compounds, hydroquinone compounds, amine compounds, quinoline compounds, and nickel salt compounds can be employed.

Specific examples of the antioxidants for use in the present invention are as follows, but are not limited to the following:

Examples of the above-mentioned phenolic compounds include 2,6-di-tert-butylphenol, 2,6-di-tert-butyl-4-methoxyphenol, 2,6-di-tert-butyl-4-methylphenol, 2-tert-butyl-4-methoxyphenol, 2,4-dimethyl-6-tert-butylphenol, 2-tert-butylphenol, 3,6-di-tert-butylphenol, 2,4-di-tert-butylphenol, 2,6-di-tert-butyl-4-ethylphenol, 2-tert-butyl-4,6-methylphenol, 2,4,6-tert-butylphenol, 2,6-di-tert-butyl-4-stearylpropionatephenol, α-tocopherol, β-tocopherol, γ-tocopherol, Naphthol AS, Naphtol AS-D, Naphtol AS-BO, 4,4'-methylenebis(2,6-di-tert-butylphenol), 4,4'-methylenebis(6-tert-butyl-4-methylphenol), 2,2'-methylenebis(4-methyl-6-tert-butylphenol), 2,2'-methylenebis(4-ethyl-6-tert-butylphenol), 2,2'-ethylenebis(4,6-di-tert-butylphenol), 2,2'-propylenebis(4,6-di-tert-butylphenol), 2,2'-butenebis(4,6-di-tert-butylphenol), 2,2'-ethylenebis(6-tert-butyl-m-cresol), 4,4'-butenebis(6-tert-butyl-m-cresol), 2,2'-butenebis(6-tert-butyl-p-cresol), 2,2'-thiobis(6-tert-butylphenol), 4,4'-thiobis(6-tert-butyl-m-cresol), 4,4'-thiobis(6-tert-o-cresol), 2,2'-thiobis(4-methyl-6-tert-butylphenol), 1,3,5-trimethyl 2,4,6-tris(3,5-di-tert-butyl-4-hydroxybenzyl)benzene, 1,3,5-trimethyl-2,4,6-tris-(3,5-di-tert-amyl-4-hydroxybenzyl)benzene, 1,3,5-trimethyl-2,4,6-tris-(3-t-butyl-5-methyl-4-hydroxybenzyl) benzene, 2-tert-butyl-5-methyl-phenylaminephenol, and 4,4'-bisamino(2-tert-butyl-4-methylphenol).

Of the above phenolic compounds, the t-butylated phenolic compounds are particularly preferable for use in the present invention.

As the organic phosphorus compounds, triphenylphosphorus, tris(nonylphenyl)phosphorus, tris (dinonylphenyl)phosphorus, tricresolphosphous, and organic phosphorous ester compounds can be employed.

The organic phosphorous ester compounds for use in the present invention are trivalent phosphorus compounds of the following formula (I):

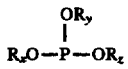

(I)

wherein $R_x$, $R_y$ and $R_z$ are independently hydrogen or an unsubstituted or substituted aliphatic or aromatic group, provided that $R_x$, $R_y$ and $R_z$ cannot be hydrogen at the same time.

When one or two of $R_x$, $R_y$ and $R_z$ are hydrogen, there is the following tautomerism:

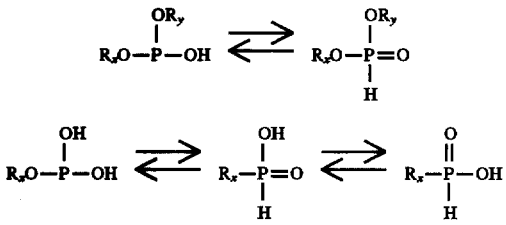

Of such phosphorous ester compounds, phosphorous ester compounds with all of $R_x$, $R_y$ and $R_z$ thereof being an unsubstituted or substituted aliphatic group having 4 or more carbon atoms, typically 4 to 26 carbon atoms, or an unsubstituted or substituted aromatic group, are preferable for use in the present invention.

Representative examples of the phosphorous ester compounds are those of the following formulae (II) to (IV):

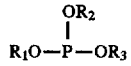

(II)

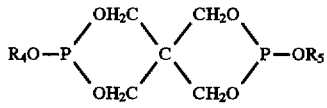

(III)

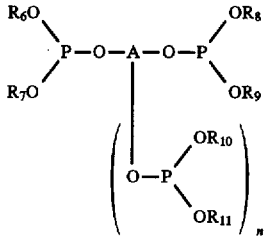

(IV)

wherein $R^1$ to $R^{11}$ independently represent a hydrogen atom, an unsubstituted or substituted alkyl group, an unsubstituted or substituted alkenyl group, an unsubstituted or substituted aryl group, or an unsubstituted or substituted allyl group such as an alkyl allyl group, provided that $R^1$ to $R^3$ cannot be hydrogen atoms at the same time; A represents an unsubstituted or substituted alkylene group, or an unsubstituted or substituted aromatic group; and n is an integer of 0 or 1.

In the above formula (II), it is preferable that all of $R^1$ to $R^3$ be an unsubstituted or substituted alkyl group or alkenyl group having 4 or more carbon atoms, typically 4 to 26 carbon atoms, or an aromatic group.

In the above formula (III), it is preferable that all of $R^4$ and $R^5$ be an unsubstituted or substituted alkyl group or alkenyl group, having 4 or more carbon atoms, typically 4 to 26 carbon atoms, or an aromatic group.

In the above formula (IV), it is preferable that n and A be respectively as follows:

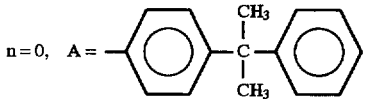

and that all of $R^6$ to $R^9$ be an unsubstituted or substituted alkyl group or alkenyl group, having 4 or more carbon atoms, typically 4 to 26 carbon atoms, or an aromatic group.

Specific examples of these phosphorous ester compounds are as follows:

Trimethyl phosphite, triethyl phosphite, tri-n-butylphosphite, trioctyl phosphite, tridecyl phosphite, tridodecyl phosphite, tristearyl phosphite, trioleyl phosphite, tristridecyl phosphite, tricetyl phosphite, dilaurlhydrodiene phosphite, diphenylmonodecyl phosphite, diphenylmono (tridecyl)phosphite, tetraphenyldipropylene glycol phosphite, 4,4'-butylidene-bis(3-methyl-6-t-phenyl-di-tridecyl)phosphite, distearyl pentaerythritol diphosphite, ditridecyl pentaerythritol diphosphite, dinonylphenyl pentaerythritol diphosphite, diphenyloctyl phosphite, tetra (tridecyl)-4,4'-isopropylidenediphenyl diphosphite, tris(2,4-di-t-butylphenyl)phosphite, tris(2,4-di-t-amylphenyl) phosphite, tris(2-t-butyl-4-methylphenyl)phosphite, tris(2-ethyl-4-methylphenyl)phosphite, tris(4-nonylphenyl) phosphite, di(2,4-di-t-butylphenyl) pentaerythritoldiphosphite, di(nonylphenyl) pentaerythritoldiphosphite, tris-(nonylphenyl)phosphite, tris (p-tert-octylphenyl)phosphite, tris(p-2-butenylphenyl) phosphite, bis(p-nonylphenyl)cyclohexylphosphite, tetrakis (2,4-di-tert-butylphenyl)-4,4'-biphenylenediphosphite, 2,6-di-tert-butyl-4-methylphenyl.phenyl.pentaerythritoldiphosphite, 2,6-di-tert-butyl-4-methylphenyl.methyl.pentaerythritoldiphosphite, 2,6-di-tert-butyl-4-ethylphenyl.stearyl.pentaerythritoldiphosphite, di(2,6-di-tert-butyl-4-methylphenyl) pentaerythritoldiphosphite, and 2,6-di-tert-amyl-4-methylphenylphenylpentaerythritoldiphosphite.

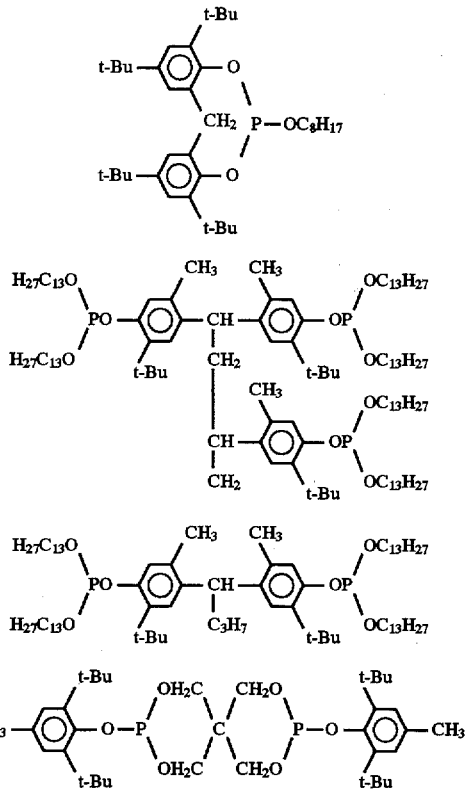

wherein t-Bu represents a tert-butyl group.

All conventional trivalent organic phosphorus compounds can be employed in the present invention.

When any of the organic phosphorous ester compounds is employed in the charge transport layer, the ratio by weight thereof to 1 part by weight of a charge transporting material is 1/10,000 to 1/10 parts by weight, preferably 3/10,000 to 3/100.

As the organic sulfur compounds, there can be employed dilauryl thiodipropionate, dimyristyl thiodipropionate, lauryl.stearyl thiodipropionate, distearyl thiodipropionate, dimethyl thiodipropionate, 2-mercaptobenzimidazole, phenothiazine, octadecyl thioglycolate, butyl thioglycolate, octyl thioglycoloate, thiocresol, and compounds of the following formulae:

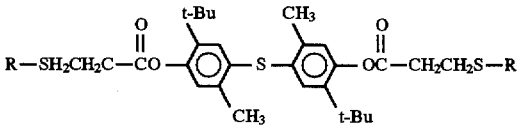

wherein R is an alkyl group having 12 to 14 carbon atoms.

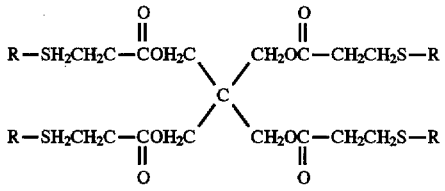

wherein R is an alkyl group having 12 carbon atoms.

As the hydroquinone compounds, there can be employed, for instance, hydroquinone, methylhydroquinone, 2,3-dimethyl-hydroquinone, 2,5-dimethylhydroquinone, 2,6-dimethyl-hydroquinone, trimethylhydroquinone, tetramethyl-hydroquinone, tert-butylhydroquinone, 2,5-di-tert-butylhydroquinone, 2,5-di-tert-amylhydroquinone, chlorohydroquinone, 2,5-di-tert-octylhydroquinone, 2,6-di-n-dodecylhydroquinone, 2-n-dodecylhydroquinone, 2-n-dodecyl-5-chlorohydroquinone, 2-tert-octyl-5-methyl-hydroquinone, 2-tert-butyl-5-methyl-hydroquinone, 2-(2-octadecyl)-5-methylhydroquinone, 1,4-diol-naphthalene, and 9,10-dielanthracene.

As the amine compounds, there can be employed, for instance, phenyl-α-naphthylamine, phenyl-β-naphthylamine, N,N'-diphenyl-p-phenylenediamine, N,N'-di-β-naphthyl-p-phenylenediamine, N,N'-diheptyl-p-phenylenediamine, N-cyclohexyl-N'-phenyl-p-phenylenediamine, N-isopropyl-N'-phenyl-p-phenylenediamine, N,N'-di(1-methylheptyl)-p-phenylenediamine, N,N'-diallyl-p-phenylenediamine, N-phenyl-N'-(1,3-dimethylbutyl)-p-phenylenediamine, N-phenyl-N'-(1-methylpropyl)-p-phenylenediamine, N-phenyl-N'-(1-methylheptyl)-p-phenylenediamine, and N,N'-diphenylethylenediamine.

As the quinoline compounds, there can be employed, for instance, 2,2,4-trimethyl-1,2-dihydroquinoline, 6-ethoxy-2,2,4trimethyl-1,2-dihydroquinoline, and 6-dodecyl-2,2,4-trimethyl-1,2-dihydroquinoline.

As the nickel salt compounds, there can be employed, for instance, nickel dibutyl dithiocarbamate and nickel isopropyl xanthate.

Of the above antioxidants, the t-butylated phenolic compounds, organic phosphoruous ester compounds, and organic sulfur compounds are particularly preferable for use in the present invention.

When any of the above-mentioned antioxidants is employed in the charge transport layer, the ratio by weight thereof to 1 part by weight of a charge transporting material is 1/10,000 to 1/10 parts by weight, preferably 3/10,000 to 3/100.

When the above ratio is less than 1/10,000 the effect of the antioxidant is not sufficient, while when the ratio exceeds 1/10, the residual potential of the photoconductor tends to be increased and therefore the photosensitivity of the photoconductor considerably decreases.

Preferable examples of the electroconductive support are materials having a volume resistivity of $10^{10}\Omega$.cm or less, including a film-shaped or cylindrical plastics materials such as polyethylene terephthalate, polybutylene terephthalate, phenolic resin, polypropylene, nylon, polystyrene, and paper, on which a metal such as aluminum, nickel, chrome, nichrome, copper, silver, gold, white gold, or stainless steel, or a metallic oxide such as tin oxide, indium oxide, nickel oxide or aluminum oxide, is deposited by vacuum deposition or coated; a plate of aluminum, an aluminum alloy, nickel, or stainless steel; a pipe made of aluminum, an aluminum alloy, nickel or stainless steel, which is fabricated by making a tube by a technique such as D.I., I.I., extrusion, punching, and subjecting the pipe to surface treatment by cutting, superfine finishing, or grinding; a film or cylinder made of any of the above-mentioned metals, fabricated, for instance, by electroplating; and a film or cylinder made of plastics with an electroconductive powder is dispersed.

Furthermore, any of the above-mentioned electroconductive supports can be employed by providing an electroconductive layer thereon, which is formed by coating thereon a dispersion of a binder resin and an electro-conductive powder. Examples of such an electroconductive power include carbon black, and acetylene black; a metallic powder such as a powder of aluminum, nickel, iron, nichrome, copper, zinc or silver; and metallic oxides such as titanium black, electroconductive tin oxide and ITO.

Examples of the binder resin to be employed in combination with the above-mentioned electroconductive powder are thermoplastic resins, thermosetting regions, and photosetting resins, such as polystyrene, styrene-acrylonitrile copolymer, styrene - butadiene copolymer, styrene - maleic anhydride copolymer, polyester, polyvinyl chloride, vinyl chloride - vinyl acetate copolymer, polyvinyl acetate, polyvinylidene chloride, polyacrylate resin, phenoxy resin, polycarbonate, cellulose acetate resin, ethyl cellulose resin, polyvinyl butyral, polyvinylcarbazole, polyvinyl toluene, poly-N-vinylcarbazole, acrylic resin, silicone resin, epoxy resin, melamine resin, urethane resin, phenolic resin and alkyd resin.

Such an electroconductive layer can be formed by dispersing any of the above-mentioned electroconductive powders and any of the above-mentioned binder resins in an appropriate solvent such as tetrahydrofuran, methylene chloride, methyl ethyl ketone, or toluene, to prepare a dispersion, and coating the thus prepared dispersion on the above-mentioned electroconductive support.

An electroconductive support for use in the present invention can also be fabricated by providing an electroconductive layer on an appropriate cylindrical substrate, which electronconductive layer can be provided by use of a heat-shrinkable tube which comprises a binder resin such as polyvinyl chloride, polypropylene, polyester, polystyrene, polyvinylidene chloride, polyethylene, chlorinated rubber or teflon, and any of the above-mentioned electroconductive powders, dispersed in the binder resin.

The charge generation layer is mainly composed of a charge generating material, with the addition of a binder resin thereto, when necessary.

Specific examples of such a binder resin for use in the charge generation layer are polyamide, polyurethane, polyester, epoxy resin, polyketone, polycarbonate, silicone resin, acrylic resin, polyvinyl butyral, polyvinyl formal, polyvinyl ketone, polystyrene, poly-N-vinylcarbazole, and polyacrylamide. These binder resins can be employed alone or in combination.

Examples of a charge generating material for use in the charge generation layer are as follows: C.I. Pigment Blue 25 (C. I. 21180), C.I. Pigment Red 41 (C.I. 21200), C.I. Acid Red 52 (C.I. 45100), C.I. Basic Red 3 (C.I. 45210); phthalocyanine pigments having a polyfine skeleton, azulenium salt pigment, squarylic salt pigment, azo pigments having a carbazole skeleton (Japanese Laid-Open Patent Application 53-95033), azo pigments having a styryl stilbene skeleton (Japanese Laid-Open Patent Application 53-138229), azo pigments having a triphenylamine skeleton (Japanese Laid-Open Patent Application 53-132547), azo pigments having a dibenzothiophene skeleton (Japanese Laid-Open Patent Application 54-21728), azo pigments having an oxadiazole skeleton (Japanese Laid-Open Patent Application 54-12742), azo pigments having a fluorenone skeleton (Japanese Laid-Open Patent Application 54-22834), azo pigments having a bisstilbene skeleton (Japanese Laid-Open Patent Application 54-17733), azo pigments having a distyryl oxadiazole skeleton (Japanese Laid-Open Patent Application 54-2129), azo pigments having a distyryl carbazole skeleton (Japanese Laid-Open Patent Application 54-17734), and triazo pigments having a carbazole skeleton (Japanese Laid-Open Patent Applications 57-195767 and 57-195768); phthalocyanine pigments such as C.I. Pigment Blue 16 (C.I. 74100); indigo pigments such as C.I. Vat Brown 5 (C.I. 73410) and C.I. Vat Dye (C.I. 73030); and perylene pigments such as Algol Scarlet B (made by Violet Co., Ltd.) and Indanthrene Scarlet R (made by Bayer Co., Ltd.). These charge generating materials may be used alone or in combination.

It is preferable that the above-mentioned binder resin be employed in a range of 0/1 to 3/1, more preferably in a range of 0/1 to 1/1, in terms of the weight ratio with respect to the amount of the charge generating material.

The charge generation layer can be provided by dispersing the charge generating material, if necessary, together with the binder resin, in a solvent such as tetrahydrofuran, cyclohexanone, methyl ethyl ketone, dioxane, or dichloroethane, in a ball mill, an attritor, or a sand mill, to prepare a charge generation layer formation liquid, diluting the charge generation layer formation liquid appropriately, and coating the liquid, for instance, on the electroconductive support.

The coating of the charge generation layer formation liquid can be carried out by conventional coating methods such as immersion coating, spray coating, and roll coating.

It is preferable that the thickness of the charge generation layer be in a range of about 0.01 to 5 μm, more preferably in a range of 0.1 to 2 μm.

The charge transport layer comprises a charge transporting material. When necessary, the charge transport layer may also comprise a binder resin.

There are two types of charge transporting materials, a positive-hole transporting material and an electron transporting material.

Specific examples of the positive-hole transporting material are electron-donating materials such as poly-N-vinylcarbazole and derivatives thereof; poly-γ-carbazolyl ethyl glutamate and derivatives thereof; pyrene - formaldehyde condensate and derivatives thereof; polyvinyl pyrene; polyvinyl phenanthrene; oxazole derivatives; oxadiazole derivatives; imidazole derivatives; triphenylamine derivatives; 9-(p-diethylaminostyryl)anthracene; 1,1-bis-(4-dibenzylaminophenyl)propane; styryl anthracene; styryl pyrazoline; phenylhydrazone; and α-phenylstilbene derivatives.

Of the above electron-donating materials, triphenylamine derivatives, phenylhydrazone and α-phenylstilbene derivatives are particularly preferable for use in the present invention.

Specific examples of the electron transporting material are electron accepting materials such as chloroanil, bromanil, tetracyanoethylene, tetracyanoquinone dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno(1,2-b)thiophene-4-on, 1,3,7-trinitrodibenzothiophenen-5,5-dioxide, diphenoquinone derivatives and thiopyran derivatives.

The above-mentioned charge transporting materials can be used alone or in combination.

Examples of a binder resin which is employed in the charge transport layer, when necessary, are thermoplastic resins and thermosetting resins, such as polystyrene, styrene - acrylonitrile copolymer, styrene - butadiene copolymer, styrene - maleic anhydride copolymer, polyester, polyvinyl chloride, vinyl chloride - vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenolic resin, and alkyd resin.

Of such binder resins, polycarbonate, polyacrylate resin, polyester, polyvinyl butyral, melamine resin and phenolic resin are particularly preferable for use in the present invention.

The above-mentioned binder resins can be employed alone or in combination.

Examples of the solvent used when forming the charge transport layer include tetrahydrofuran, dioxane, toluene, monochlorobenzene, dichloroethane, and methylene chloride.

It is preferable that the above-mentioned binder resin be employed in an amount in a range of 10/1 to 1/100, more preferably in a range of 3/1 to 1/10, in terms of the weight ratio with respect to the amount of the charge transporting material.

It is preferable that the thickness of the charge transport layer be in a range of about 5 to 100 μm.

In the present invention, a plasticizer and a leveling agent may be added to the charge transport layer.

As the plasticizer for use in the charge transport layer, conventional plasticizers such as dibutyl phthalate, and dioctyl phthalate can be employed as they are. It is preferable that such a plasticizer be employed in an amount in a range of 0 to about 30 wt. % of the entire weight of the charge transport layer.

As the leveling agent for use in the charge transport layer, silicone oils such as dimethyl silicone oil and methylphenyl silicone oil can be employed. It is preferable that such a leveling agent be employed in an amount in a range of 0 to about 1 wt. % of the entire weight of the charge transport layer.

In the present invention, when necessary, the provision of an undercoat layer comprising a binder resin is effective.

As the binder resin for use in the undercoat layer, there can be employed thermoplastic resin such as polyamide, polyester, vinyl chloride - vinyl acetate copolymer; and thermosetting resins which are prepared, for instance, by thermally polymerizing a compound having a plurality of active hydrogen atoms, for instance, such hydrogen atoms as in —OH group, —$NH_2$ group, and —NH group, and a compound having a plurality of isocyanate groups and/or a compound having a plurality of epoxy groups.

Examples of the compound having a plurality of active hydrogen atoms are polyvinyl butyral, phenoxy resin, phenolic resin, polyamide, polyester, and acrylic resins with groups including active hydrogen atoms such as a hydroxyethyl methacrylate group.

Examples of the compound having a plurality of isocyanate groups are tolylenediisocyanate, hexamethylene diisocyanate and diphenylmethane diisocyanate; and prepolymers thereof.

Examples of the compound having a plurality of epoxy groups include bisphenol A type epoxy resin.

As a binder resin for the undercoat layer, there can be employed thermosetting resins prepared by thermally polymerizing an oil-free alkyd resin and an amino resin such as butylated melamine resin; and photosetting resins prepared by polymerizing resins having unsaturated bonds, such as polyurethane having unsaturated bonds, and unsaturated polyester, in combination with a photo polymerization initiator such as a thioxanthone compound or methylbenzyl formate.

The above-mentioned resins can be used alone or in combination, and also can be employed in the form of a solution by dissolving them in solvents.

In order to improve the characteristics of the undercoat layer, a metallic oxide in the form of a powder may be added to any of the binder resins for the undercoat layer.

Examples of such a metallic oxide are $SnO_2$, $Sb_2O_3$, $In_2O_3$, ZnO, $TiO_2$, $SiO_2$, $ZrO_2$ and $Al_2O_3$. These metallic oxides can be used alone or in combination.

When such a metallic oxide powder is employed, the metallic powder is dispersed together with a solvent and a binder resin, for instance, in a ball mill, a sand mill or an attritor, thereby preparing an undercoat layer formation liquid.

The thus prepared undercoat layer formation liquid is coated on the electroconductive support, for instance, by roll coating, immersion coating, spray coating, nozzle coating, or blade coating, dried, and/or cured by the application of heat or light.

It is preferable that the thickness of the undercoat layer be in a range of 0.1 to 30 μm, more preferably in a range of 0.2 to 10 μm.

When the previously mentioned metallic oxide is employed in the undercoat layer, it is preferable that the volume ratio of the metallic oxide to the binder resin be in a range of 0.5/1 to 3/1.

In the electrophotographic photoconductor according to the present invention, the charge generation layer and the charge transport layer can be successively overlaid on the electroconductive support in this order, or the charge generation layer may be overlaid on the charge transport layer in the order opposite to the above.

Furthermore, an insulating layer or a protective layer may be provided on the photoconductive layer comprising the charge generation layer and the charge transport layer.

Other features of this invention will become apparent in the course of the following description of exemplary embodiments, which are given for illustration of the invention and are not intended to be limiting thereof.

EXAMPLE 1

[Preparation of Charge Generation Layer Formation Liquid]

A mixture of the following components was mixed and ground in a ball mill for 48 hours:

| | Parts by Weight |
|---|---|
| 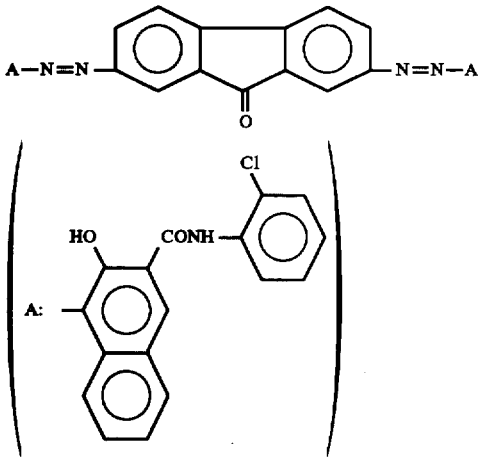 | 45 |
| Polyester (Trademark: "Vylon 300", made by Toyobo Co., Ltd.) | 18 |
| Cyclohexanone | 600 |
| Polyalkylene glycol (Trademark: "Terathane T-2900", made by Du Pont de Nemours, E. I. & Co.) | 4.5 |

The above mixture was then diluted with a mixed solvent with the following formulation, whereby a charge generation layer formation liquid was prepared:

| | Parts by Weight |
|---|---|
| Cyclohexanone | 1650 |
| 4-methyl-2-pentanone | 750 |

The thus prepared charge generation layer formation liquid was coated on an outer surface of an aluminum drum with a diameter of 80 mm, and dried at 110° C. for 15 minutes, whereby a charge generation layer with a thickness of 0.2 μm was formed on the aluminum drum.

[Preparation of Charge Transport Layer Formation Liquid]

A mixture of the following components was mixed and dissolved, whereby a charge transport layer formation liquid was prepared:

| | Parts by Weight |
|---|---|
| 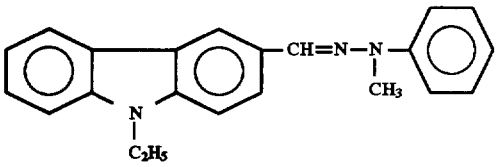 | 430 |
| Polycarbonate resin (Trademark: "Panlilte K-1300", made by Teijin Chemicals Ltd.) | 470 |
| 1,2-dichloromethane | 4100 |
| 2,5-di-tert-amylhydroquinone | 0.86 |
| Silicone oil (Trademark: "KF-50", made by Shin-Etsu Chemical. Co., Ltd.) | 0.09 |

The thus prepared charge transport layer formation liquid was coated on the charge generation layer by immersion coating and dried at 110° C. for 50 minutes, whereby a charge transport layer with a thickness of 20 μm was formed.

Thus, an electrophotographic photoconductor No. 1-1 of the present invention was fabricated.

The electrophotographic photoconductor was then evaluated as follows:

The photoconductor was negatively charged under the application of a charging voltage of −6 kV thereto by corona charging for 20 seconds by use of a cylindrical rotating testing apparatus equipped with a charging unit, an exposure unit and a sensor for measuring the surface potential of the photoconductor.

The thus charged photoconductor was then subjected to dark decay by allowing the photoconductor to stand in the dark for 10 seconds without applying any charges thereto.

The photoconductor was then illuminated by a tungsten lamp in such a manner that the illuminance on the illuminated surface of the photoconductor was 20 lux.

In the course of the above-mentioned charging and exposing steps, the surface potential $V_1$ (V) of the photoconductor 1 second after the initiation of the corona charging, the surface potential after the 10-second dark decay, and the surface potential 20 seconds after the initiation of the corona charging were respectively measured. The value obtained by dividing the surface potential after the 10-second dark decay by the surface potential 20 seconds after the initiation of the corona charging was calculated as being the value DD.

Furthermore, the surface potential Vr (V) after the illuminance of the photoconductor by the tungsten lamp for 10 seconds was also measured.

The photoconductor was then charged until the surface potential thereof reached −800 V, and illuminated with the tungsten lamp in such a manner that the illuminance on the illuminated surface of the photoconductor was 20 lux, so that the exposure $E_{1/2}$ (lux.sec) required to reduce the above surface potential to ½ thereof was measured.

The results are shown in TABLE 1.

A charger with a length of 10 cm and an LED were incorporated in the above-mentioned testing apparatus, and a fatigue test was conducted by repeating charging and exposing the photoconductor to the light from the LED for 8 hours under the conditions that the quantity of the liquid from the LED was set at 5 mW/m$^2$, and the charger was caused to charge in such a manner that the current passing through the photoconductor was 60 μA.

After this fatigue test, the previously mentioned evaluation tests were repeated, whereby $V_1(V)$, DD, $V_2(V)$ and $E_{1/2}$(lux.sec) of the photoconductor were measured.

The results are shown in TABLE 1.

The previously mentioned charge transport layer formation liquid was circulated for 20 days with in an apparatus comprising a coating chamber through which the liquid was constantly circulated in an overflowing manner with a flow rate of 5 l/min, and a reservoir of the liquid.

An electrophotographic photoconductor No. 1-2 was fabricated in exactly the same manner as in the case of the electrophotographic photoconductor No. 1-1 except that the charge transport layer formation liquid employed for the electrophotographic photoconductor No. 1-1 was replaced by the charge transport layer formation liquid after the 20 -day circulation.

The thus fabricated electrophotographic photoconductor No. 1-2 was evaluation in exactly the same manner as in the case of the electrophotographic photoconductor No. 1-1. The results are shown in TABLE 1.

EXAMPLE 2

The procedure for the fabrication of the electrophotographic photoconductors Nos. 1-1 and 1-2 in Example 1 was repeated except that the formulation of the charge transport layer formation liquid in Example 1 was changed to the following, whereby electrophotographic photoconductors Nos. 2-1 and 2-2 of the present invention were fabricated:

[Formulation of Charge Transport Layer Formation Liquid]

| | Parts by Weight |
|---|---|
| 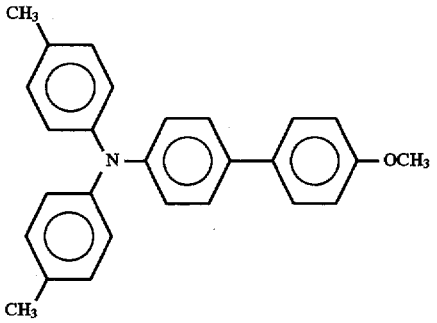 | 370 |
| Polycarbonate resin (Trademark: "Iupilon Z-300", made by Mitsubishi Gas Chemical Company, Inc.) | 530 |
| Tetrahydrofuran | 4100 |
| N-isopropyl-N'-phenyl-p-phenylenediamine | 1.85 |
| Silicone oil (Trademark: "KF-50", made by Shin-Etsu Chemical Co., Ltd.) | 0.11 |

EXAMPLE 3

The procedure for the fabrication of the electrophotographic photoconductors Nos. 1-1 and 1-2 in Example 1 was repeated except that 4.5 parts by weight of the polyalkylene glycol (Trademark: "Terathane T2900", made by Du Pont de Nemours, E.I. & Co.) in the formation of the charge generation layer formation liquid in Example 1 were replaced by 36 parts by weight of polyalkylene glycol diester (Trademark: "Ionet DS-400", made by Sanyo Chemical Industries, Ltd.) and that the formulation of the charge transport layer formation liquid in Example 1 was changed to the following, whereby electrophotographic photoconductors Nos. 3-1 and 3-2 of the present invention were fabricated:

[Formulation of Charge Transport Layer Formation Liquid]

| | Parts by Weight |
|---|---|
| 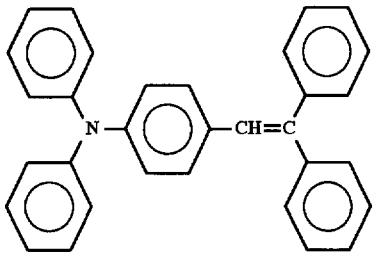 | 430 |
| Polycarbonate resin (Trademark: "Iupilon Z-300", made by Mitsubishi Gas Chemical Company, Inc.) | 470 |
| Tetrahydrofuran | 4100 |
| α-tocopherol | 4.3 |
| Silicone oil (Trademark: "KF-50", made by Shin-Etsu Chemical Co., Ltd.) | 0.09 |

EXAMPLE 4

The procedure for the fabrication of the electrophotographic photoconductors Nos. 1-1 and 1-2 in Example 1 was repeated except that 4.5 parts by weight of the polyalkylene glycol (Trademark: "Terathan T-2900", made by Du Pont de Nemours, E.I. & Co.) in the formulation of the charge generation layer formation liquid in Example 1 were replaced by 4.5 parts by weight of a copolymer of ethylene glycol and i-propylene glycol (Trademark: "Newpol PE68", may be Sanyo Chemical Industries, Ltd.) and that the formulation of the charge transport layer formation liquid in Example 1 was changed to the following, whereby electrophotographic photo-conductors Nos. 4-1 and 4-2 of the present invention were fabricated:

[Formulation of Charge Transport Layer Formation Liquid]

| | Parts by Weight |
|---|---|
| 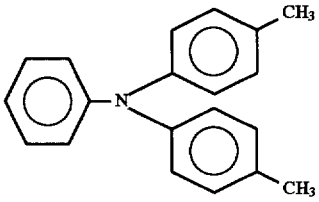 | 430 |
| Polycarbonate resin (Trademark: "Iupilon Z-200", made by Mitsubishi Gas Chemical Company Inc.) | 470 |
| Dioxane | 4100 |
| 1,4-diolnaphthalene | 1.3 |
| Silicone oil (Trademark: "KP-50", made by Shin-Etsu Chemical Co., Ltd.) | 0.09 |

EXAMPLE 5

The procedure for the fabrication of the electrophotographic photoconductors Nos. 1-1 and 1-2 in Example 1 was repeated except that 4.5 parts by weight of the polyalkylene glycol (Trademark: "Terathane T-2900", made by Du Pont de Nemours, E.I. & Co.) in the formulation of the charge generation layer formation liquid in Example 1 were replaced by 13.5 parts by weight of polyalkylene glycol monoether (Trademark: "Emulmin L380", made by Sanyo Chemical Industries, Ltd.) and that 0.86 parts by weight of 2,5-di-tert-amylhydroquinone in the formulation of the charge transport layer formation liquid in Example 1 were replaced by 4.3 parts by weight of 2,6-di-tert-butylphenol, whereby electrophotographic photoconductors Nos. 5-1 and 5-2 of the present invention were fabricated.

EXAMPLE 6

The procedure for the fabrication of the electrophotographic photoconductors Nos. 1-1 and 1-2 in Example 1 was repeated except that 0.86 parts by weight of 2,5-di-tert-amylhydroquinone in the formulation of the charge transport layer formation liquid in Example 1 were replaced by 8.6 parts by weight of 2,6-di-tert-methylphenol, whereby electrophotographic photoconductors Nos. 6-1 and 6-2 of the present invention were fabricated.

EXAMPLE 7

The procedure for the fabrication of the electrophotographic photoconductors Nos. 1-1 and 1-2 in Example 1 was repeated except that 4.5 parts by weight of the polyalkylene glycol (Trademark: "Terathane T-2900", made by Du Pont de Nemours, E.I. & Co.) in the formulation of the charge generation layer formation liquid in Example 1 were replaced by 23 parts by weight of polyalkylene glycol diester (Trademark: "Ionet DC-300", made by Sanyo Chemical Industries, Ltd.), and that the formulation of the charge transport layer formation liquid in Example 1 was changed to the following, whereby electrophotographic photo-conductors Nos. 7-1 and 7-2 of the present invention were fabricated:

[Formulation of Charge Transport Layer Formation Liquid]

| | Parts by Weight |
|---|---|
| 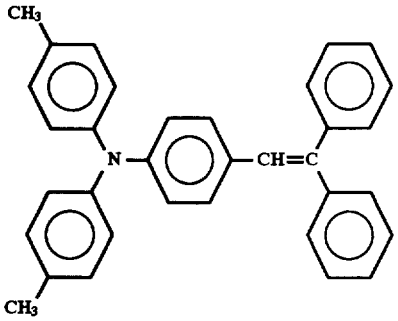 | 430 |
| Polycarbonate resin (Trademark: "Panlite C-1400", made by Teijin Chemicals Ltd.) | 470 |
| 1,2-dichloromethane | 4100 |
| 2,2'-methylenebis(4-methyl-6-tert-butylphenol) | 4.3 |
| Silicone oil (Trademark: "KF-50", made by Shin-Etsu Chemical Co., Ltd.) | 0.09 |

EXAMPLE 8

The procedure for the fabrication of the electrophotographic photoconductors Nos. 1-1 and 1-2 in Example 1 was repeated except that 0.86 parts by weight of 2,5-di-tert-amylhydroquinone in the formulation of the charge transport layer formation liquid in Example 1 were replaced by 4.3 parts by weight of tri(2,4-di-tert-butylphenyl)phosphite, whereby electrophotographic photoconductors Nos. 8-1 and 8-2 of the present invention were fabricated.

EXAMPLE 9

The procedure for the fabrication of the electrophotographic photoconductors Nos. 1-1 and 1-2 in Example 1 was repeated except that 4.5 parts by weight of the polyalkylene glycol (Trademark: "Terathane T-2900", made by Du Pont de Nemours, E.I. & Co.) in the formulation of the charge generation layer formation liquid in Example 1 were replaced by 4.5 parts by weight of a copolymer of ethylene glycol and i-propylene glycol (Trademark: "Newpol PE68", made by Sanyo Chemical Industries, Ltd.) and that the formulation of the charge transport layer formation liquid in Example 1 was changed to the following, whereby electrophotographic photo-conductors Nos. 9-1 and 9-2 of the present invention were fabricated:

[Formulation of Charge Transport Layer Formation Liquid]

| | Parts by Weight |
|---|---|
| 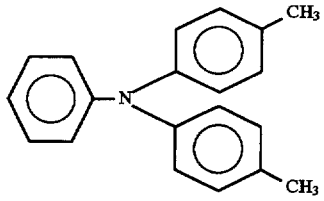 | 430 |
| Polycarbonate resin (Trademark: "Iupilon Z-200", made by Mitsubishi Gas Chemical Company Inc.) | 470 |
| Dioxane | 4100 |
| Tristearyl phosphite | 0.86 |
| Silicone oil (Trademark: "KF-50", made by Shin-Etsu Chemical Co., Ltd.) | 0.09 |

EXAMPLE 10

The procedure for the fabrication of the electrophotographic photoconductors Nos. 1-1 and 1-2 in Example 1 was repeated except that the formulation of the charge transport layer formation liquid in Example 1 was changed to the following, whereby electrophotographic photoconductors Nos. 10-1 and 10-2 of the present invention were fabricated:

[Formulation of Charge Transport Layer Formation

| | Parts by Weight |
|---|---|
| 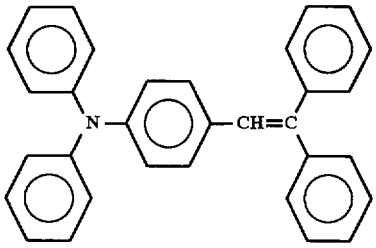 | 430 |

-continued

[Formulation of Charge Transport Layer Formation

| | Parts by Weight |
|---|---|
| Polycarbonate resin (Z-type, M.W. 50,000, made by Teijin Chemicals Ltd.) | 470 |
| Tetrahydrofuran | 4100 |
| Distearyl thiodipropionate | 8.6 |
| Silicone oil (Trademark: "KF-50", Shin Etsu Chemical Co., Ltd.) | 0.09 |

EXAMPLE 11

The procedure for the fabrication of the electrophotographic photoconductors Nos. 1-1 and 1-2 in Example 1 was repeated except that 4.5 parts by weight of the polyalkylene glycol (Trademark: "Terathane T-2900", made by Du Pont de Nemours, E.I. & Co.) in the formulation of the charge generation layer formation liquid in Example 1 were replaced by 4.5 parts by weight of a copolymer of ethylene glycol and i-propylene glycol (Trademark: "Newpol PE68", made by Sanyo Chemical Industries, Ltd.) and that 0.86 parts by weight of 2,5-di-tert-amyl-hydroquinone in the formulation of the charge transport layer formation liquid in Example 1 were replaced by 4.3 parts by weight of dimyristyl thiodipropionate, whereby electrophotographic photoconductors Nos. 11-1 and 11-2 of the present invention were fabricated.

EXAMPLE 12

The procedure for the fabrication of the electrophotographic photoconductors Nos. 1-1 and 1-2 in Example 1 was repeated except that the formulation of the charge generation layer formation liquid and the formulation of the charge transport layer formation liquid in Example 1 were respectively changed as follows, whereby electrophotographic photoconductors Nos. 12-1 and 12-2 of the present invention were fabricated:

| | Parts by Weight |
|---|---|
| 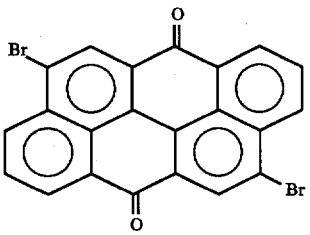 | 45 |
| Polyvinyl butyral resin (Trademark: "Denka Butyral #4000-1", made by Denki Kagaku Kogyo K.K.) | 18 |
| Cyclohexanone | 600 |
| Polyalkylene glycol (Trademark: "Terathane T-2900", made by Du Pont de Nemours, E. I. & Co.) | 4.5 |

The above mixture was ground in a ball mill for 48 hours and then diluted with a mixed solvent with the following formulation, whereby a charge generation layer formation liquid was prepared:

| | Parts by Weight |
|---|---|
| Cyclohexanone | 1650 |
| 4-methyl-2-pentanone | 750 |

[Formulation of Charge Transport Layer Formation Liquid]

| | Parts by Weight |
|---|---|
| 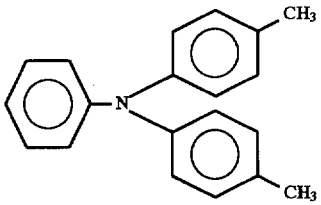 | 430 |
| Polycarbonate resin (Trademark: "Iupilon Z-200", made by Mitsubishi Gas Chemical Company Inc.) | 470 |
| Dioxane | 4100 |
| 2,6-di-tert-butyl-4-methoxyphenol | 4.3 |
| Silicone oil (Trademark: "KF-50", made by Shin-Etsu Chemical Co., Ltd.) | 0.09 |

EXAMPLE 13

The procedure for the fabrication of the electrophotographic photoconductors Nos. 1-1 and 1-2 in Example 1 was repeated except that the formulation of the charge generation layer formation liquid and the formulation of the charge transport layer formation liquid in Example 1 were respectively changed as follows, whereby electrophotographic photoconductors Nos. 13-1 and 13-2 of the present invention were fabricated:

[Formulation of Charge Generation Layer Formation Liquid]

| | Parts by Weight |
|---|---|
| 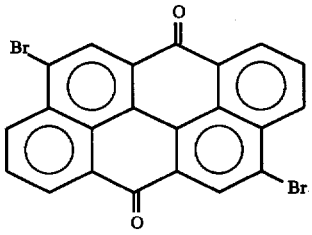 | 45 |
| Polyvinyl butyral resin (Trademark: "Denka Butyral #4000-1", made by Denki Kagaku Kogyo K.K.) | 18 |
| Cyclohexanone | 600 |
| Polyalkylene glycol diester (Trademark: "Ionet DS-400", made by Sanyo Chemical Industries, Ltd.) | 13.5 |

The above mixture was ground in a ball mill for 48 hours and then diluted with a mixed solvent with the following formulation, whereby a charge generation layer formation liquid was prepared:

| | Parts by Weight |
|---|---|
| Cyclohexanone | 1650 |
| 4-methyl-2-pentanone | 750 |

[Formulation of Charge Transport Layer Formation Liquid]

| | Parts by Weight |
|---|---|
| 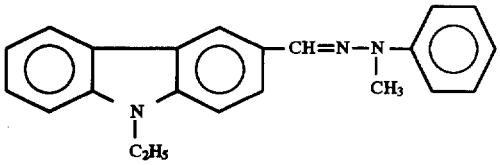 | 430 |
| Polycarbonate resin (Trademark: "Panlilte K-1300", made by Teijin Chemicals Ltd.) | 470 |
| 1,2-dichloromethane | 4100 |
| Trioleylphosphite | 4.3 |
| Silicone oil (Trademark: "KF-50", made by Shin-Etsu Chemical Co., Ltd.) | 0.09 |

EXAMPLE 14

The procedure for the fabrication of the electrophotographic photoconductors Nos. 1-1 and 1-2 in Example 1 was repeated except that the formulation of the charge generation layer formation liquid in Example 1 was changed to the following, and that 0.86 parts by weight of 2,5-di-tert-amylhydroquinone in the formulation of the charge transport layer formation liquid in Example 1 were replaced by 2.2 parts by weight of dilauryl thiodipropionate, whereby electrophotographic photoconductors Nos. 14-1 and 14-2 of the present invention were fabricated:

The above mixture was ground in a ball mill for 48 hours and then diluted with a mixed solvent with the following formulation, whereby a charge generation layer formation liquid was prepared:

| | Parts by Weight |
|---|---|
| Cyclohexanone | 1650 |
| Cyclohexane | 750 |

[Formulation of Charge Generation Layer Formation Liquid]

| | Parts by Weight |
|---|---|
| 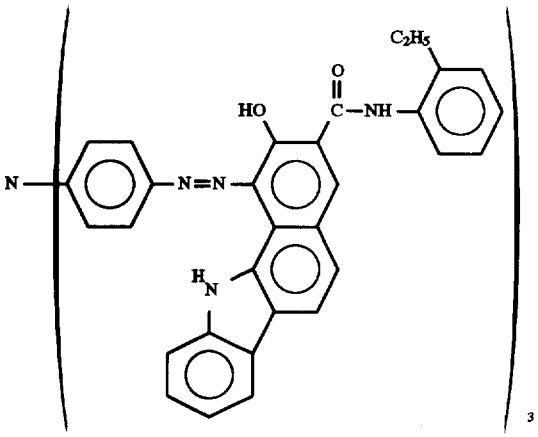 | 45 |
| Polyvinyl butyral resin (Trademark: "S-Lec BM-S", made by Sekisui Chemical Co., Ltd.) | 18 |
| Cyclohexanone | 600 |
| Polyalkylene glycol (Trademark: "Terathane T-2900", made by Du Pont de Nemours, E. I. & Co.) | 4.5 |

EXAMPLE 15

The procedure for the fabrication of the electrophotographic photoconductors Nos. 1-1 and 1-2 in Example 1 was repeated except that the formulation of the charge generation layer formation liquid and the formulation of the charge transport layer formation liquid in Example 1 were respectively changed as follows, whereby electrophotographic photoconductors Nos. 15-1 and 15-2 of the present invention were fabricated:

[Formulation of Charge Generation Layer Formation Liquid]

| | Parts by Weight |
|---|---|
| 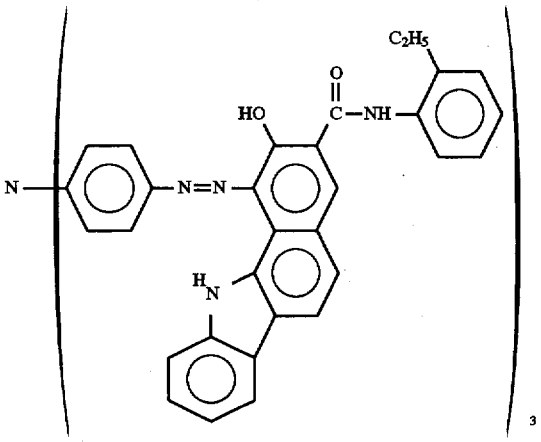 | 45 |
| Polyvinyl butyral resin (Trademark: "S-Lec BM-S", made by Sekisui Chemical Co., Ltd.) | 18 |
| Cyclohexanone | 600 |
| Copolymer of ethylene glycol and i-propylene glycol (Trademark: "Newpol PE68", made by Sanyo Chemical Industries, Ltd.) | 4.5 |

The above mixture was ground in a ball mill for 48 hours and then diluted with a mixed solvent with the following formulation, whereby a charge generation layer formation liquid was prepared:

| | Parts by Weight |
|---|---|
| Cyclohexanone | 1650 |
| Cyclohexane | 750 |

[Formulation of Charge Transport Layer Formation Liquid]

| | Parts by Weight |
|---|---|
| 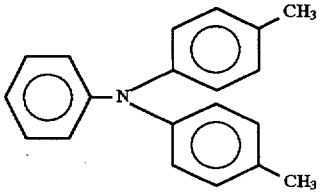 | 430 |
| Polycarbonate resin (Trademark: "Iupilon Z-200", made by Mitsubishi Gas Chemical Company Inc.) | 470 |
| Dioxane | 4100 |

-continued

| | |
|---|---|
| 4,4'-thiobis-(6-tert-butyl-m-cresol) | 4.3 |
| Silicone oil (Trademark: "KF-50", made by Shin-Etsu Chemical Co., Ltd.) | 0.09 |

EXAMPLE 16

The procedure for the fabrication of the electrophotographic photoconductors Nos. 1-1 and 1-2 in Example 1 was repeated except that the formulation of the charge generation layer formation liquid in Example 1 was changed to the following, and that 0.86 parts by weight of 2,5-di-tert-amylhydroquinone in the formulation of the charge transport layer formation liquid in Example 1 were replaced by 1.3 parts by weight of tri(4-nonylphenyl)phosphite, whereby electrophotographic photoconductors Nos. 16-1 and 16-2 of the present invention were fabricated:

[Formulation of Charge Generation Layer Formation Liquid]

| | Parts by Weight |
|---|---|
| 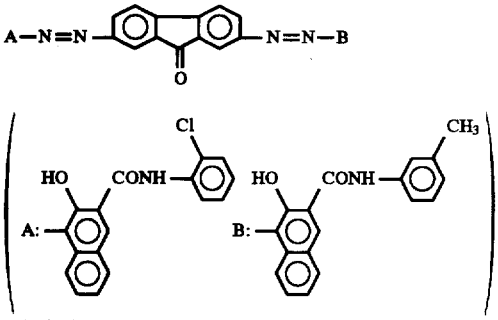 | 45 |
| Polyvinyl butyral resin (Trademark: "S-Lec BM-S", made by Sekisui Chemical Co., Ltd.) | 18 |
| Cyclohexanone | 600 |
| Polyalkylene glycol (Trademark: "Terathane T-2900", made by Du Pont de Nemours, E. I. & Co.) | 4.5 |

The above mixture was ground in a ball mill for 48 hours and then diluted with a mixed solvent with the following formulation, whereby a charge generation layer formation liquid was prepared:

| | Parts by Weight |
|---|---|
| Cyclohexanone | 1650 |
| Methyl ethyl ketone | 750 |

EXAMPLE 17

The procedure for the fabrication of the electrophotographic photoconductors Nos. 1-1 and 1-2 in Example 1 was repeated except that the formulation of the charge generation layer formation liquid and the formulation of the charge transport layer formation liquid in Example 1 were respectively changed as follows, whereby electrophotographic photoconductors Nos. 17-1 and 17-2 of the present invention were fabricated:

[Formulation of Charge Generation Layer Formation Liquid]

| | Parts by Weight |
|---|---|
| 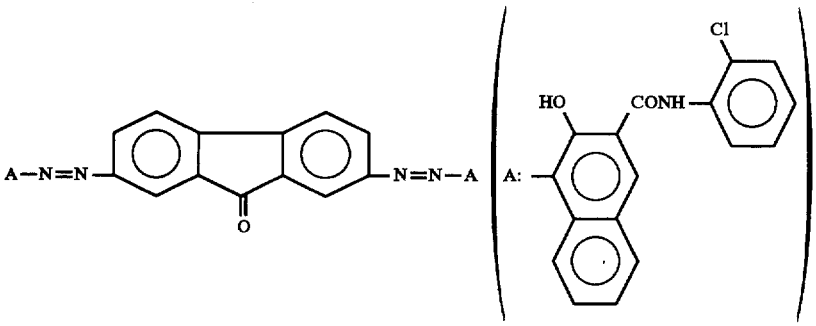 | 45 |
| Polyvinyl butyral resin (Trademark: "Denka Butyral #4000-1", made by Denki Kagaku Kogyo K. K.) | 18 |
| Cyclohexanone | 600 |
| Dibenzo-18-crown-6-ether | 4.5 |

The above mixture was ground in a ball mill for 48 hours and then diluted with a mixed solvent with the following formulation, whereby a charge generation layer formation liquid was prepared:

| | Parts by Weight |
|---|---|
| Cyclohexanone | 1650 |
| Cyclohexane | 750 |

[Formulation of Charge Transport Layer Formation Liquid]

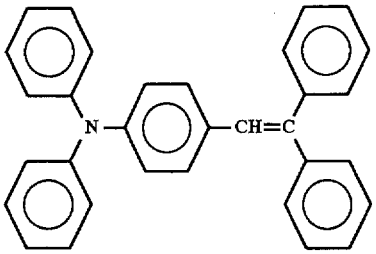

| | |
|---|---|
| | 430 |
| Polycarbonate resin (Trademark: "Iupilon Z-300", made by Mitsubishi Gas Chemical Company, Inc.) | 470 |
| Tetrahydrofuran | 4100 |
| 2-tert-butyl-5-methylhydroquinone | 1.3 |
| Silicone oil (Trademark: "KF-50", made by Shin-Etsu Chemical Co., Ltd.) | 0.09 |

EXAMPLE 18

The procedure for the fabrication of the electrophotographic photoconductors Nos. 1-1 and 1-2 in Example 1 was repeated except that the formulation of the charge generation layer formation liquid in Example 1 was changed to the following, and 0.86 parts by weight of 2,5-di-tert-amylhydroquinone in the formulation of the charge transport layer formation liquid in Example 1 were replaced by 2.2 parts by weight of tris(dinolylphenyl) phosphorus, whereby electrophotographic photoconductors Nos. 18-1 and 18-2 of the present invention were fabricated:

formulation, whereby a charge generation layer formation liquid was prepared:

| | Parts by Weight |
|---|---|
| Cyclohexanone | 1650 |
| Cyclohexane | 750 |

EXAMPLE 19

The procedure for the fabrication of the electrophotographic photoconductors Nos. 1-1 and 1-2 in Example 1 was repeated except that the formulation of the charge generation layer formation liquid was changed to the following, and that 0.86 parts by weight of 2,5-di-tert-amylhydroquinone in the formulation of the charge transport layer formation liquid in Example 1 were replaced by 8.6 parts by weight of 2,6-di-tert-methylphenol, whereby electrophotographic photoconductors Nos. 19-1 and 19-2 of the present invention were fabricated:

[Formulation of Charge Generation Layer Formation Liquid]

| | Parts by Weight |
|---|---|
| | 45 |
| Polyvinyl butyral resin (Trademark: "Denka Butyral #4000-1", made by Denki Kagaku Kogyo K. K.) | 18 |
| Cyclohexanone | 600 |
| Dibenzo-18-crown-6-ether | 4.5 |

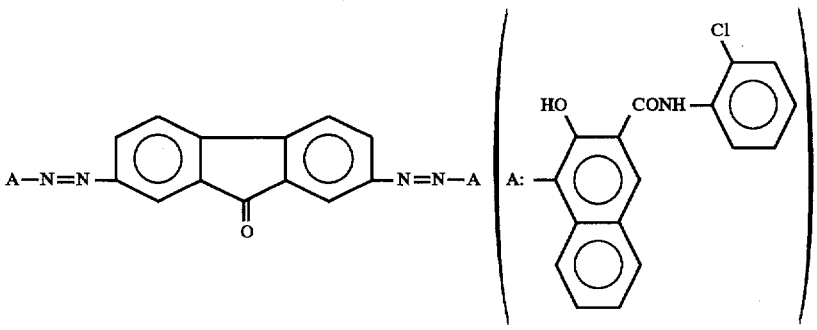

The above mixture was ground in a ball mill for 48 hours and then diluted with a mixed solvent with the following

[Formulation of Charge Generation Layer Formation Liquid]

| | Parts by Weight |
|---|---|
| 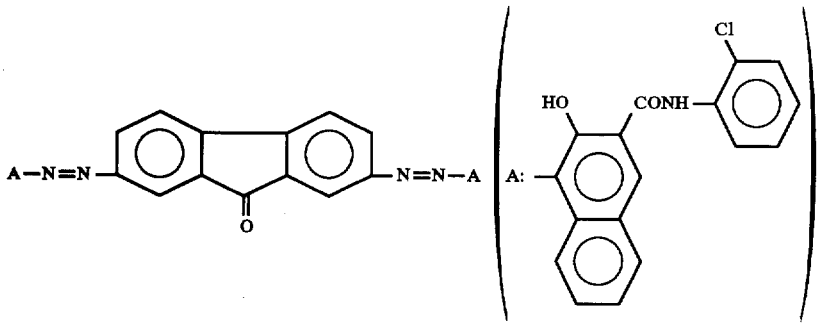 | 45 |
| Polyvinyl butyral resin (Trademark: "Denka Butyral #4000-1", made by Denki Kagaku Kogyo K. K.) | 18 |
| Cyclohexanone | 600 |
| Tribenzo-18-crown-6-ether | 4.5 |

The above mixture was ground in a ball mill for 48 hours and then diluted with a mixed solvent with the following formulation, whereby a charge generation layer formation liquid was prepared:

| | Parts by Weight |
|---|---|
| Cyclohexanone | 1650 |
| Cyclohexane | 750 |

EXAMPLE 20

The procedure for the fabrication of the electrophotographic photoconductors Nos. 1-1 and 1-2 in Example 1 was repeated except that the formulation of the charge generation layer formation liquid and the formulation of the charge transport layer formation liquid in Example 1 were respectively changed as follows, whereby electrophotographic photoconductors Nos. 20-1 and 20-2 of the present invention were fabricated:

The above mixture was ground in a ball mill for 48 hours and then diluted with a mixed solvent with the following formulation, whereby a charge generation layer formation liquid was prepared:

| | Parts by Weight |
|---|---|
| Cyclohexanone | 1650 |
| Cyclohexane | 750 |

[Formulation of Charge Transport Layer Formation Liquid]

| | |
|---|---|
| 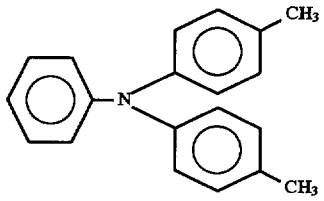 | 430 |

[Formulation of Charge Generation Layer Formation Liquid]

| | Parts by Weight |
|---|---|
| 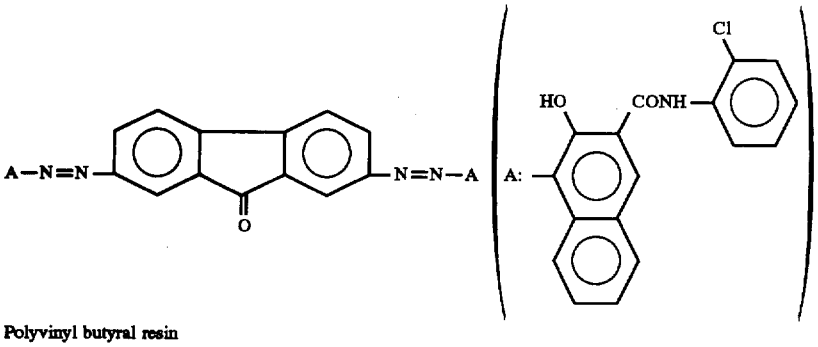 | 45 |
| Polyvinyl butyral resin (Trademark: "Denka Butyral #4000-1", made by Denki Kagaku Kogyo K. K.) | 18 |
| Cyclohexanone | 600 |
| Tribenzo-18-crown-6-ether | 4.5 |

-continued

| | Parts by Weight |
|---|---|
| Polycarbonate resin (Trademark: "Iupilon Z-200", made by Mitsubishi Gas Chemical Company Inc.) | 470 |
| Dioxane | 4100 |
| 2,6-di-tert-butyl-4-methoxyphenol | 4.3 |
| Silicone oil (Trademark: "KF-50", made by Shin-Etsu Chemical Co., Ltd.) | 0.09 |

EXAMPLE 21

The procedure for the fabrication of the electrophotographic photoconductors Nos. 1-1 and 1-2 in Example 1 was repeated except that the formulation of the charge generation layer formation liquid in Example 1 was changed to the following, and that 0.86 parts by weight of 2,5-di-tert-amylhydroquinone in the formulation of the charge transport layer formation liquid in Example 1 were replaced by 4.3 parts by weight of tri(2,4-di-tert-butylphenyl)phosphite, whereby electrophotographic photoconductors Nos. 21-1 and 21-2 of the present invention were fabricated:

[Formulation of Charge Generation Layer Formation Liquid]

| | Parts by Weight |
|---|---|
| 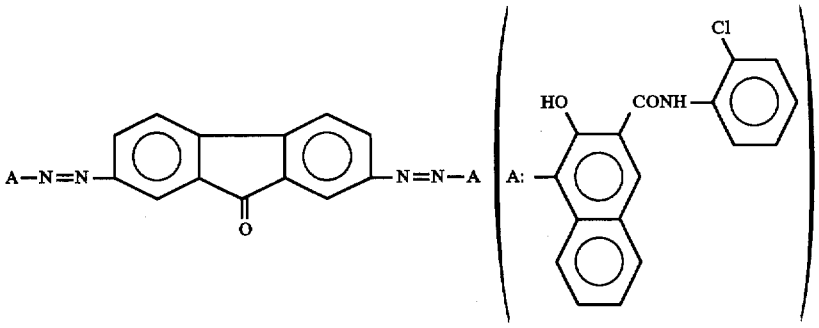 | 45 |
| Polyvinyl butyral resin (Trademark: "Denka Butyral #4000-1", made by Denki Kagaku Kogyo K. K.) | 18 |
| Cyclohexanone | 600 |
| Dibenzo-18-crown-6-ether | 4.5 |

The above mixture was ground in a ball mill for 48 hours and then diluted with a mixed solvent with the following formulation, whereby a charge generation layer formation liquid was prepared:

| | Parts by Weight |
|---|---|
| Cyclohexanone | 1650 |
| Cyclohexane | 750 |

EXAMPLE 22

The procedure for the fabrication of the electrophotographic photoconductors Nos. 1-1 and 1-2 in Example 1 was repeated except that the formulation of the charge generation layer formation liquid and the formulation of the charge transport layer formation liquid in Example 1 were changed as follows, whereby electrophotographic photoconductors Nos. 22-1 and 22-2 of the present invention were fabricated:

[Formulation of Charge Generation Layer Formation Liquid]

| | Parts by Weight |
|---|---|
| 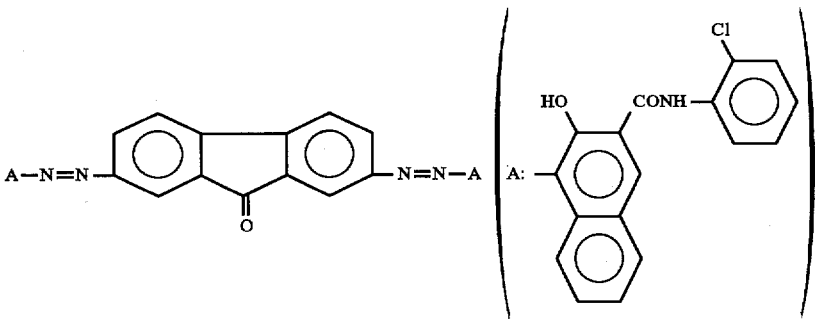 | 45 |

-continued

[Formulation of Charge Generation Layer Formation Liquid]

| | Parts by Weight |
|---|---|
| Polyvinyl butyral resin (Trademark: "Denka Butyral #4000-1", made by Denki Kagaku Kogyo K. K.) | 18 |
| Cyclohexanone | 600 |
| Dibenzo-18-crown-6-ether | 4.5 |

The above mixture was ground in a ball mill for 48 hours and then diluted with a mixed solvent with the following formulation, whereby a charge generation layer formation liquid was prepared:

| | Parts by Weight |
|---|---|
| Cyclohexanone | 1650 |
| Cyclohexane | 750 |

[Formulation of Charge Transport Layer Formation Liquid]

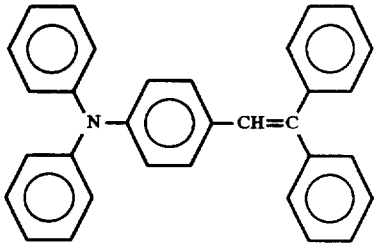

| | |
|---|---|
| | 370 |
| Polycarbonate resin (Z-type, M.W. 50,000, made by Teijin Chemicals Ltd.) | 530 |
| 1,2-dichloromethane | 4100 |
| Trioctyl phosphite | 3.7 |

-continued

| | Parts by Weight |
|---|---|
| Silicone oil (Trademark: "KF-50", Shin-Etsu Chemical Co., Ltd.) | 0.11 |

EXAMPLE 23

The procedure for the fabrication of the electrophotographic photoconductors Nos. 1-1 and 1-2 in Example 1 was repeated except that the formulation of the charge generation layer formation liquid in Example 1 was changed to the following, and that 0.86 parts by weight of 2,5-di-tert-amylhydroquinone in the formulation of the charge transport layer formation liquid in Example 1 were replaced by 2.2 parts by weight of dilauryl thiodipropionate, whereby electrophotographic photoconductors Nos. 23-1 and 23-2 of the present invention were fabricated:

[Formulation of Charge Generation Layer Formation Liquid]

| | Parts by Weight |
|---|---|
| 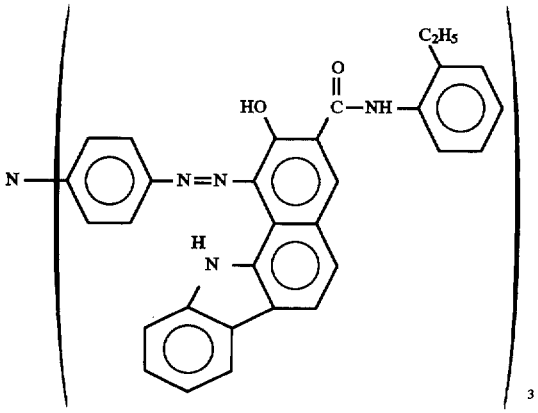 | 45 |
| Polyvinyl butyral resin (Trademark: "Denka Butyral #4000-1", made by Denki Kagaku Kogyo K. K.) | 18 |
| Cyclohexanone | 600 |
| Dibenzo-18-crown-6-ether | 4.5 |

The above mixture was ground in a ball mill for 48 hours and then diluted with a mixed solvent with the following formulation, whereby a charge generation layer formation liquid was prepared:

| | Parts by Weight |
|---|---|
| Cyclohexanone | 1650 |
| Cyclohexane | 750 |

EXAMPLE 24

The procedure for the fabrication of the electrophotographic photoconductors Nos. 1-1 and 1-2 in Example 1 was repeated except that the formulation of the charge generation layer formation liquid and the formulation of the charge transport layer formation liquid in Example 1 were respectively changed as follows, whereby electrophotographic photoconductors Nos. 24-1 and 24-2 of the present invention were fabricated:

[Formulation of Charge Generation Layer Formation Liquid]

| | Parts by Weight |
|---|---|
| 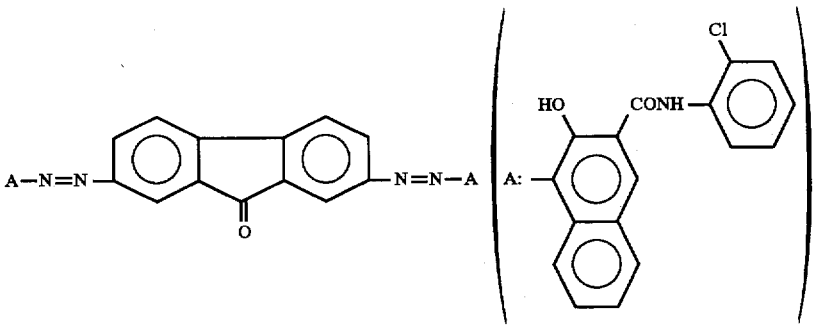 | 45 |
| Polyvinyl butyral resin (Trademark: "Denka Butyral #4000-1", made by Denki Kagaku Kogyo K. K.) | 18 |
| Cyclohexanone | 600 |
| Dibenzo-18-crown-6-ether | 4.5 |

The above mixture was ground in a ball mill for 48 hours and then diluted with a mixed solvent with the following formulation, whereby a charge generation layer formation liquid was prepared:

| | Parts by Weight |
|---|---|
| Cyclohexanone | 1650 |
| Cyclohexane | 750 |

[Formulation of Charge Transport Layer Formation

| | |
|---|---|
| 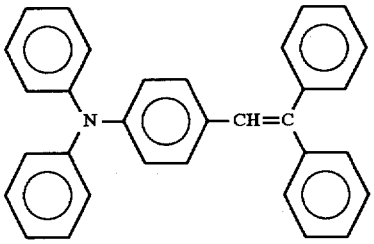 | 430 |

-continued

| | Parts by Weight |
|---|---|
| Polycarbonate resin (Z-type, M.W. 50,000, made by Teijin Chemicals Ltd.) | 470 |
| Tetrahydrofuran | 4100 |
| Distearyl thiodipropionate | 8.6 |
| Silicone oil (Trademark: "KF-50", Shin-Etsu Chemical Co., Ltd.) | 0.09 |

EXAMPLE 25

The procedure for the fabrication of the electrophotographic photoconductors Nos. 1-1 and 1-2 in Example 1 was repeated except that an undercoat layer with a thickness of 0.5 μm was provided between the aluminum drum serving as electroconductive support and the charge generation layer, which was formed by coating an undercoat layer formation liquid with the following formulation on the aluminum drum by immersion coating, and drying the coated liquid at 100° C. for 30 minutes, whereby electrophotographic photoconductors Nos. 25-1 and 25-2 of the present invention were fabricated:

[Formulation of Undercoat Layer Formation Liquid]

| | Parts by Weight |
|---|---|
| Alcohol-soluble nylon (Trademark: "Amilan CM-8000", made by Toray Industries, Inc.) | 160 |
| Methanol | 3840 |

EXAMPLE 26

The procedure for the fabrication of the electrophotographic photoconductors Nos. 5-1 and 5-2 in Example 5 was repeated except that an undercoat layer with a thickness of 0.3 μm was provided between the aluminum drum serving as electroconductive support and the charge generation layer, which was formed by coating an undercoat layer formation liquid with the following formulation on the aluminum drum by immersion coating, and drying the coated liquid at 110°

C. for 30 minutes, whereby electrophotographic photoconductors Nos. 26-1 and 26-2 of the present invention were fabricated:

| | Parts by Weight |
|---|---|
| Vinyl chloride - vinyl acetate - maleic anhydride copolymer resin (Tradmark: "S-Lec MF-10", made by Sekisui Chemical Co., Ltd.) | 120 |
| Methyl ethyl ketone | 2880 |
| Isopropanol | 1000 |

EXAMPLE 27

The procedure for the fabrication of the electrophotographic photoconductors Nos. 13-1 and 13-2 in Example 13 was repeated except that an undercoat layer with a thickness of 0.3 μm was provided between the aluminum drum serving as electroconductive support and the charge generation layer, which was formed by coating an undercoat layer formation liquid with the following formulation on the aluminum drum by immersion coating, and drying the coated liquid at 110° C. for 30 minutes, whereby electrophotographic photoconductors Nos. 27-1 and 27-2 of the present invention were fabricated:

| | Parts by Weight |
|---|---|
| Vinyl chloride - vinyl acetate - maleic anhydride copolymer resin (Tradmark: "S-Lec MF-10", made by Sekisui Chemical Co., Ltd.) | 120 |
| Methyl ethyl ketone | 2880 |
| Isopropanol | 1000 |

EXAMPLE 28

The procedure for the fabrication of the electrophotographic photoconductors Nos. 1-1 and 1-2 in Example 1 was repeated except that the charge generation layer formation liquid employed in Example 1 was replaced by the charge generation layer formation liquid employed in Example 17, and the charge transport layer formation liquid employed in Example 1 was replaced by the charge transport layer formation liquid employed in Example 24, and that an undercoat layer with a thickness of 2 μm was provided between the aluminum drum serving as electroconductive support and the charge generation layer, whereby electrophotographic photoconductors Nos. 28-1 and 28-2 of the present invention were fabricated.

An undercoat layer formation liquid was prepared by dispersing the following components in a ball mill for 12 hours, and diluting the dispersion with a mixed solvent composed of 900 parts by weight of methanol and 870 parts by weight of n-butanol:

[Formulation of Undercoat Layer Formation Liquid]

| | Parts by Weight |
|---|---|
| Alcohol-soluble nylon (Trademark: "Amilan CM-8000", made by Toray Industries, Inc.) | 420 |

-continued

[Formulation of Undercoat Layer Formation Liquid]

| | Parts by Weight |
|---|---|
| Titanium oxide powder (Trademark: "TA-300", made by Ishihara Sangyo Kaisha, Ltd.) | 1680 |
| Methanol | 1130 |

The undercoat layer was formed on the drum by coating the above undercoat layer formation liquid thereon by immersion coating, and drying the coated liquid at 100° C. for 30 minutes.

COMPARATIVE EXAMPLE 1

The procedure for the fabrication of the electrophotographic photoconductors Nos. 1-1 and 1-2 in Example 1 was repeated except that the polyalkylene glycol was eliminated from the charge generation layer in Example 1, and that the 2,5-di-tert-amylhydroquinone was eliminated from the charge transport layer in Example 1, whereby comparative electrophotographic photoconductors Nos. 1-1 and 1-2 were fabricated.

COMPARATIVE EXAMPLE 2

The procedure for the fabrication of the electrophotographic photoconductors Nos. 25-1 and 25-2 in Example 25 was repeated except that the polyalkylene glycol was eliminated from the charge generation layer in Example 25, and that the 2,5-di-tert-amylhydroquinone was eliminated from the charge transport layer in Example 25, whereby comparative electrophotographic photoconductors Nos. 2-1 and 2-2 were fabricated.

COMPARATIVE EXAMPLE 3

The procedure for the fabrication of the electrophotographic photoconductors Nos. 1-1 and 1-2 in Example 1 was repeated except that the 2,5-di-tert-amylhydroquinone was eliminated from the charge transport layer in Example 1, whereby comparative electrophotographic photoconductors Nos. 3-1 and 3-2 were fabricated.

COMPARATIVE EXAMPLE 4

The procedure for the fabrication of the electrophotographic photoconductors Nos. 1-1 and 1-2 in Example 1 was repeated except that the polyalkylene glycol was eliminated from the charge generation layer in Example 1, whereby comparative electrophotographic photoconductors Nos. 4-1 and 4-2 were fabricated.

COMPARATIVE EXAMPLE 5

The procedure for the fabrication of the comparative electrophotographic photoconductors Nos. 4-1 and 4-2 in Comparative Example 4 was repeated except that the amount of 2,5-di-tert-amylhydroquinone employed in the charge transport layer formation liquid in Comparative Example 4 was increased to 8.6 parts by weight, whereby comparative electrophotographic photoconductors Nos. 5-1 and 5-2 were fabricated.

EXAMPLE 29

The procedure for the fabrication of the electrophotographic photoconductors Nos. 3-1 and 3-2 in Example 3 was repeated except that the charge generation layer formation liquid employed in Example 3 was replaced by a charge generation layer formation liquid with the following formulation, and that an undercoat layer with a thickness of 0.3 μm was provided between the aluminum drum serving as electroconductive support and the charge generation layer, which was formed by coating an undercoat layer formation liquid with the following formulation on the aluminum drum by immersion coating, and drying the coated liquid at 100° C. for 30 minutes, whereby electrophotographic photoconductors Nos. 29-1 and 29-2 of the present invention were fabricated:

| | Parts by Weight |
|---|---|
| [Formulation of Undercoat Layer Formation Liquid] | |
| Vinyl chloride - vinyl acetate - maleic anhydride copolymer resin (Trademark: "S-Lec MF-10", made by Sekisui Chemical Co., Ltd.) | 120 |
| Methyl ethyl ketone | 2880 |
| Isopropanol | 1000 |
| Polyalkylene glycol (Trademark: "Terathane T-2900", made by Du Pont de Nemours, E. I. & Co.) | 12 |
| [Formulation of Charge Generation Layer Formation Liquid] | |
| 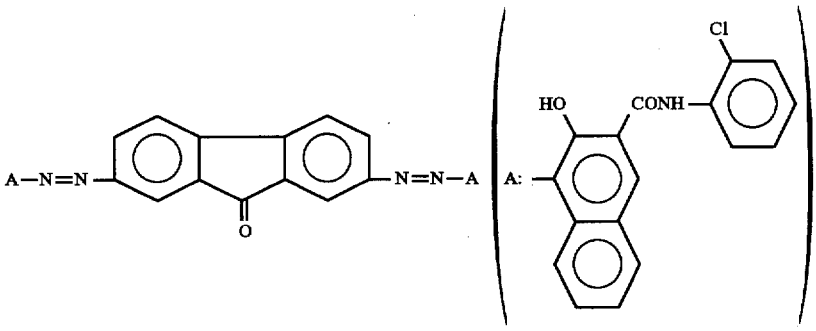 | 45 |
| Polyvinyl butyral resin (Trademark: "Denka Butyral #4000-1", made by Denki Kagaku Kogyo K. K.) | 4.5 |
| Cyclohexanone | 600 |

The above mixture was ground in a ball mill for 48 hours and then diluted with a mixed solvent with the following formulation, whereby a charge generation layer formation liquid was prepared:

| | Parts by Weight |
|---|---|
| Cyclohexanone | 1650 |
| Cyclohexane | 750 |

EXAMPLE 30

The procedure for the fabrication of the electrophotographic photoconductors Nos. 4-1 and 4-2 in Example 4 was repeated except that the charge generation layer formation liquid employed in Example 4 was replaced by a charge generation layer formation liquid with the following formulation, and that an undercoat layer with a thickness of 0.5 μm was provided between the aluminum drum serving as electroconductive support and the charge generation layer, which was formed by coating an undercoat layer formation liquid with the following formulation on the aluminum drum by immersion coating, and drying the coated liquid at 100° C. for 30 minutes, whereby electrophotographic photoconductors Nos. 30-1 and 30-2 of the present invention were fabricated:

| | Parts by Weight |
|---|---|
| [Formulation of Undercoat Layer Formation Liquid] | |
| Alcohol-soluble nylon (Trademark: "Amilan CM-8000", made by Toray Industries, Inc.). | 160 |
| Methanol | 3840 |
| Alkylene glycol diester | 80 |

-continued

| | Parts by Weight |
|---|---|
| (Trademark: "Ionet DS-400", made by Sanyo Chemical Industries, Ltd.) | |
| [Formulation of Charge Generation Layer Formation Liquid] | |
| 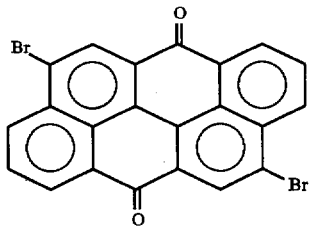 | 45 |

-continued

| | Parts by Weight |
|---|---|
| Polyvinyl butyral resin (Trademark: "XYHL", made by Union Carbide Corp.) | 4.5 |
| Cyclohexanone | 600 |

The above mixture was ground in a ball mill for 48 hours and then diluted with a mixed solvent with the following formulation, whereby a charge generation layer formation liquid was prepared:

| | Parts by Weight |
|---|---|
| Cyclohexanone | 1650 |
| 4-methyl-2-pentanone | 750 |

EXAMPLE 31

The procedure for the fabrication of the electrophotographic photoconductors Nos. 30-1 and 30-2 in Example 30 was repeated except that the charge transport layer formation liquid employed in Example 30 was replaced by a charge transport layer formation liquid with the following formulation, and that the same undercoat layer as in Example 29 was provided between the aluminum drum serving as electroconductive support and the charge generation layer, whereby electrophotographic photoconductors Nos. 31-1 and 31-2 of the present invention were fabricated:

[Formulation of Charge Transport Layer Formation Liquid]

| | Parts by Weight |
|---|---|
| 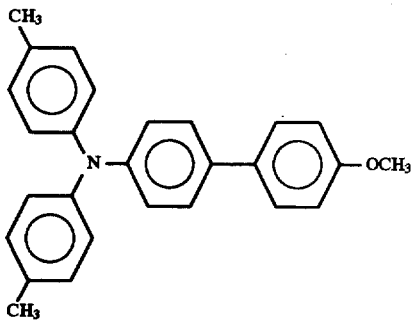 | 370 |
| Polyester resin (Trademark: "Vylon 200", made by Toyobo Co., Ltd.) | 530 |
| 1,2-dichloromethane | 4100 |
| 4,4'-butylidene-bis(3-methyl-6-tert-butylphenylditridecyl)-phosphite | 3.7 |
| Silicone oil (Trademark: "KF-50", made by Shin-Etsu Chemical Co., Ltd.) | 0.11 |

photographic photoconductors Nos. 1-1 and 1-2 in Example 1 was repeated except that the charge generation layer formation liquid employed in Example 1 was replaced by the charge generation layer formation liquid employed in Example 30, and 0.86 parts by weight of 2,5-di-tert-amylhydroquinone in the formulation of the charge transport layer formation liquid in Example 1 were replaced by 8.6 parts by weight of 2,6-di-tert-methylphenol, and that an undercoat layer with a thickness of 5 μm was provided between the aluminum drum serving as electroconductive support and the charge generation layer, which was formed by coating an undercoat layer formation liquid with the following formulation on the aluminum drum by immersion coating, and drying the coated liquid at 100° C. for 50 minutes, whereby electrophotographic photoconductors Nos. 32-1 and 32-2 of the present invention were fabricated:

[Formulation of Undercoat Layer Formation Liquid]

| | Parts by Weight |
|---|---|
| Tin oxide (made by Mitsubishi Materials Corportation) | 2140 |
| Alcohol-soluble nylon (Trademark: "Amilan CM-8000", made by Toray Industries, Inc.) | 360 |
| Methanol | 1400 |

The above mixture was dispersed in a ball mill for 12 hours, and the dispersion was diluted with a mixed solvent with the following formulation, whereby an undercoat layer formation liquid was prepared:

| | Parts by Weight |
|---|---|
| Methanol | 350 |
| Isopropanol | 750 |
| Polyalkylene glycol (Trademark: "Terathane T-2900", made by Du Pont de Nemours, E. I. & Co.) | 18 |

EXAMPLE 33

[Preparation of Undercoat Layer Formation Liquid]

A mixture of the following components was dispersed in a ball mill for 12 hours:

| | Parts by Weight |
|---|---|
| Indium oxide (made by Mitsubishi Materials Corportation) | 2000 |
| Alcohol-soluble nylon (Trademark: "Amilan CM-8000", made by Toray Industries, Inc.) | 500 |
| Methanol | 1400 |
| Polyalkylene glycol monoether (Trademark: "Emulmin L380", made by Sanyo Chemical Industries, Ltd.) | 40 |

The above dispersion was diluted with a mixed solvent with the following formulation, whereby an undercoat layer formation liquid was prepared:

| | Parts by Weight |
|---|---|
| Methanol | 350 |
| n-butanol | 750 |

The thus prepared undercoat layer formation liquid was coated on an outer surface of an aluminum drum with a diameter of 80 mm, and dried at 100° C. for 50 minutes, whereby an undercoat layer with a thickness of 5 μm was formed on the aluminum drum.

[Preparation of Charge Generation Layer Formation Liquid]

A mixture of the following components was mixed and ground in a ball mill for 48 hours:

| | Parts by Weight |
|---|---|
| 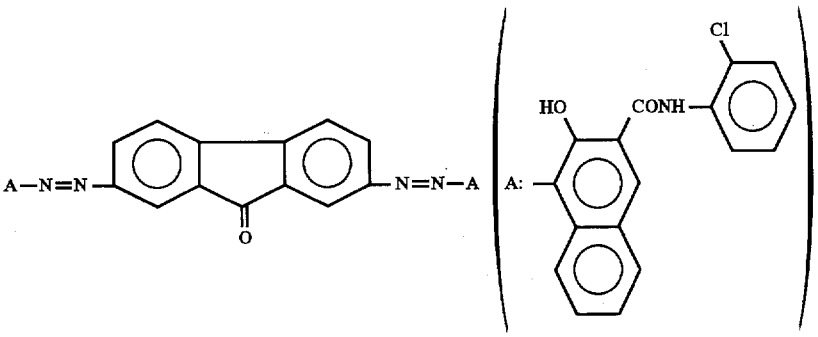 | 45 |
| Polyester (Trademark: "Vylon 300", made by Toyobo Co., Ltd.) | 18 |
| Cyclohexanone | 600 |

The above mixture was then diluted with a mixed solvent with the following formulation, whereby a charge generation layer formation liquid was prepared:

| | Parts by Weight |
|---|---|
| Cyclohexanone | 1650 |
| 4-methyl-2-pentanone | 750 |

The thus prepared charge generation layer formation liquid was coated on the undercoat layer, and dried at 110° C. for 15 minutes, whereby a charge generation layer with a thickness of 0.2 μm was formed on the undercoat layer.

[Preparation of Charge Transport Layer Formation Liquid]

A mixture of the following components was mixed and dispersed, whereby a charge transport layer formation liquid was prepared:

| | Parts by Weight |
|---|---|
| 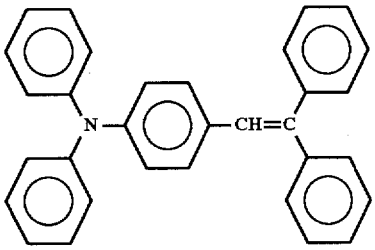 | 370 |
| Polycarbonate resin (Trademark: "Iupilon Z-300", made by Mitsubishi Gas Chemical Company, Inc.) | 530 |
| 1,2-dichloromethane | 4100 |
| 1,3,5-trimethyl-2,4,6-tris-(3,5-di-tert-butyl-4-hydroxybenzyl)benzene | 1.9 |
| Silicone oil (Trademark: "XF-50" made by Shin-Etsu Chemical Co., Ltd.) | 0.11 |

The thus prepared charge transport layer formation liquid was coated on the charge generation layer by immersion coating and dried at 110° C. for 50 minutes, whereby a charge transport layer with a thickness of 20 μm was formed on the charge generation layer.

Thus, an electrophotographic photoconductor No. 33-1 of the present invention was fabricated.

An electrophotographic photoconductor No. 33-2 was also fabricated in exactly the same manner as in the case of the electrophotographic photoconductor No. 33-1 except that the charge transport layer formation liquid employed for the electrophotographic photoconductor No. 33-1 was replaced by the charge transport layer formation liquid after the 20-day circulation as in Example 1.

EXAMPLE 34

[Preparation of Undercoat Layer Formation Liquid]

A mixture of the following components was dispersed in a ball mill for 36 hours:

| | Parts by Weight |
|---|---|
| Titanium oxide (Trademark: "CR-EL", made by Ishihawa Sangyo Kaisha, Ltd.) | 1800 |
| Alkyd resin (Trademark: "Beckosol 1307-60-EL", made by Dainippon Ink & Chemicals, Incorporated) | 450 |
| Melamine resin (Trademark: "Super Beckamine G821-60", made by Dainippon Ink & Chemicals, Incorporated) | 300 |
| Methyl ethyl ketone | 1150 |
| Copolymer of ethylene glycol and i-propylene glycol (Trademark: "Newpol PE68", made by Sanyo Chemical Industries, Ltd.) | 36 |

The above dispersion was then diluted with a mixed solvent with the following formulation, whereby an undercoat layer formation liquid was prepared:

| | Parts by Weight |
|---|---|
| Methyl ethyl ketone | 700 |
| n-butanol | 600 |

The thus prepared undercoat layer formation liquid was coated on an outer surface of an electro-forming nickel belt with a diameter of 80 mm by immersion coating, dried and cured at 130° C. for 30 minutes, whereby an undercoat layer with a thickness of 3 μm was formed on the nickel belt.

[Preparation of Charge Generation Layer Formation Liquid]

A mixture of the following components was mixed and ground in a ball mill for 48 hours:

| | Parts by Weight |
|---|---|
| 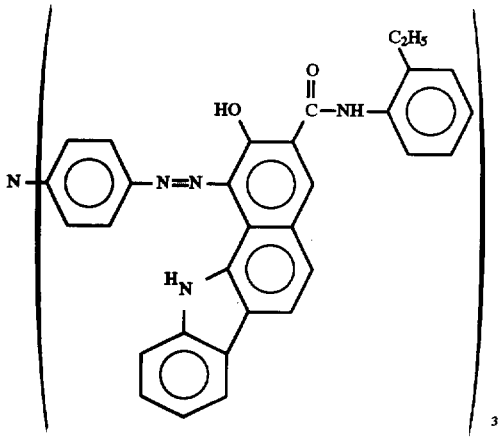 | 45 |
| Polyvinyl butyral resin (Trademark: "S-Lec BM-S", made by Sekisui Chemical Co., Ltd.) | 9 |
| Cyclohexanone | 600 |

The above dispersion was diluted with a mixed solvent with the following formulation, whereby a charge generation layer formation liquid was prepared:

| | Parts by weight |
|---|---|
| Cyclohexanone | 1650 |
| Cyclohexane | 750 |

The thus prepared generation layer formation liquid was coated on the undercoat layer, and dried at 110° C. for 15 minutes, whereby a charge generation layer with a thickness of 0.2 μm was formed on the undercoat layer.

[Preparation of Charge Transport Layer Formation Liquid]

A mixture of the following components was mixed and dispersed, whereby a charge transport layer formation liquid was prepared:

| | Parts by Weight |
|---|---|
| 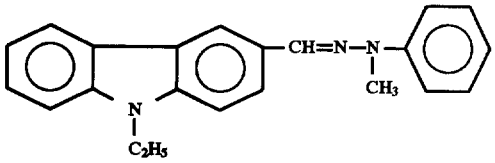 | 430 |
| Polycarbonate resin (Z-type, M.W. 50,000, made by Teijin Chemicals, Ltd.) | 470 |
| Dioxane | 4100 |
| Lauryl stearyl thiodipropionate | 4.3 |
| Silicone oil (Trademark: "KF-50", made by Shin-Etsu Chemical Co., Ltd.) | 0.09 |

The thus prepared charge transport layer formation liquid was coated on the charge generation layer by immersion coating and dried at 110° C. for 50 minutes, whereby a charge transport layer with a thickness of 20 μm was formed on the charge generation layer.

Thus, an electrophotographic photoconductor No. 34-1 of the present invention was fabricated.

An electrophotographic No. 34-2 was also fabricated in exactly the same manner as in the case of the electrophotographic photoconductor No. 34-1 except that the charge transport layer formation liquid employed for the electrophotographic photoconductor No. 34-1 was replaced by the charge transport layer formation liquid after the 20-day circulation as in Example 1.

EXAMPLE 35

[Preparation of Undercoat Layer Formation Liquid]

A mixture of the following components was dispersed in a ball mill for 36 hours:

| | Parts by Weight |
|---|---|
| Zirconium oxide (made by Furuuchi Chemical Corporation) | 1800 |
| Alkyd resin (Trademark: "Beckosol 1307-60-EL", made by Dainippon Ink & Chemicals, Incorporated) | 300 |
| Melamine resin (Trademark: "Super Beckamine G821-60", made by Dainippon Ink & Chemicals, Incorporated) | 200 |
| Methyl ethyl ketone | 1200 |

The above dispersion was then diluted with a mixed solvent with the following formulation, whereby an undercoat layer formation liquid was prepared:

| | Parts by Weight |
|---|---|
| Polyaklylene glycol diester (Trademark: "Ionet DS-400", made by Sanyo Chemical Industries, Ltd.) | 45 |
| Methyl ethyl ketone | 800 |
| Methanol | 700 |

The thus prepared undercoat layer formation liquid was coated on an aluminum-deposited seamless polyimide belt-shaped film with a diameter of 80 mm by immersion coating, dried and cured at 130° C. for 30 minutes, whereby an undercoat layer with a thickness of 1 μm was formed on the polyimide film.

[Preparation of Charge Generation Layer Formation Liquid]

A mixture of the following components was mixed and ground in a ball mill for 48 hours:

| | Parts by Weight |
|---|---|
| 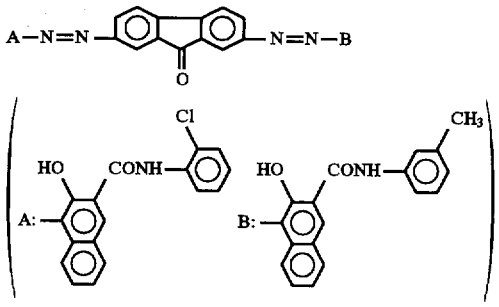 | 45 |

-continued

| | Parts by Weight |
|---|---|
| Polyvinyl butyral resin (Trademark: "XYHL", made by Union Carbide Corp.) | 4.5 |
| Cyclohexanone | 600 |

The above dispersion was then diluted with a mixed solvent with the following formulation, whereby a charge generation layer formation liquid was prepared:

| | Parts by Weight |
|---|---|
| Cyclohexanone | 1400 |
| Methyl ethyl ketone | 1000 |

The thus prepared charge generation layer formation liquid was coated on the undercoat layer, and dried at 110° C. for 15 minutes, whereby a charge generation layer with a thickness of 0.2 μm was formed on the undercoat layer.

[Preparation of Charge Transport Layer Formation Liquid]

The same charge transport layer formation liquid as prepared in Example 6 was prepared.

The thus prepared charge transport layer formation liquid was coated on the charge generation layer by immersion coating and dried at 110° C. for 50 minutes, whereby a charge transport layer with a thickness of 20 μm was formed on the charge generation layer.

Thus, an electrophotographic photoconductor No. 35-1 of the present invention was fabricated.

An electrophotographic photoconductor No. 35-2 was also fabricated in exactly the same manner as in the case of the electrophotographic photoconductor No. 35-1 except that the charge transport layer formation liquid employed for the electrophotographic photoconductor No. 35-1 was replaced by the charge transport layer formation liquid after the 20-day circulation as in Example 1.

EXAMPLE 36

The procedure for the fabrication of the electrophotographic photoconductors Nos. 7-1 and 7-2 in Example 7 was repeated except that the formulation of the charge generation layer formation liquid in Example 7 was changed to the same formulation of the charge generation layer formation liquid as in Example 33 and that an undercoat layer with a thickness of 5 μm was provided between the aluminum drum serving as electroconductive support and the charge generation layer, which was formed by coating an undercoat layer formation liquid with the following formulation on the aluminum drum by immersion coating, and drying the coated liquid at 100° C. for 50 minutes, whereby electrophotographic photoconductors Nos. 36-1 and 36-2 of the present invention were fabricated:

| | Parts by Weight |
|---|---|
| Tin oxide (made by Mitsubishi Materials Corporation) | 2140 |
| Alcohol-soluble nylon (Trademark: "Amilan CM-8000", made by Toray Industries, Inc.) | 360 |
| Methanol | 1400 |

The above mixture was dispersed in a ball mill for 12 hours, and the dispersion was diluted with a mixed solvent with the following formulation, whereby an undercoat layer formation liquid was prepared:

| | Parts by Weight |
|---|---|
| Methanol | 350 |
| Isopropanol | 756 |
| Copolymer of ethylene glycol and i-propylene glycol (Trademark: "Newpol PE68", Sanyo Chemical Industries, Ltd.) | 36 |

EXAMPLE 37

The procedure for the fabrication of the electrophotographic photoconductors Nos. 9-1 and 9-2 in Example 9 was repeated except that the formulation of the charge generation layer was changed to the same formulation of the charge generation layer as in Example 35, and that an undercoat layer with a thickness of 5 μm was provided between the aluminum drum serving as electroconductive support and the charge generation layer, which was formed by coating an undercoat layer formation liquid with the following formulation on the aluminum drum by immersion coating, and drying the coated liquid at 130° C. for 30 minutes, whereby electrophotographic photoconductors Nos. 37-1 and 37-2 of the present invention were fabricated:

| | Parts by Weight |
|---|---|
| Indium oxide (made by Mitsubishi Materials Corporation) | 2000 |
| Alkyd resin (Trademark: "Beckosol 1307-60-EL", made by Dainippon Ink & Chemicals, Incorporated) | 400 |
| Melamine resin (Trademark: "Super Beckamine G821-60", made by Dainippon Ink & Chemicals, Incorporated) | 267 |
| Methyl ethyl ketone | 1400 |

The above dispersion was diluted with a mixture of the following components, whereby the above-mentioned undercoat layer formation liquid was prepared:

| | Parts by Weight |
|---|---|
| Copolymer of ethylene glycol and i-propylene glycol (Trademark: "Newpol PE68", Sanyo Chemical Industries, Ltd.) | 40 |
| Methyl ethyl ketone | 333 |
| n-butanol | 600 |

The procedure for the fabrication of the electrophotographic photoconductors Nos. 22-1 and 22-2 in Example 22 was repeated except that the formulation of the charge generation layer was changed to the same formulation of the charge generation layer as in Example 35, and 3.7 parts by weight of trioctyl phosphite in the formulation of the charge transport layer in Example 22 were replaced by 3.7 parts by weight of tri(2,4-di-t-butylphenyl)phosphite, and that an undercoat layer with a thickness of 3 μm was provided between the aluminum drum serving as electroconductive support and the charge generation layer, which was formed by coating an undercoat layer formation liquid with the following formulation on the aluminum drum by immersion coating, and drying the coated liquid at 130° C. for 30 minutes, whereby electrophotographic photoconductors Nos. 38-1 and 38-2 of the present invention were fabricated:

[Preparation of Undercoat Layer Formation Liquid]

A mixture of the following components was dispersed in a ball mill for 36 hours:

| | Parts by Weight |
|---|---|
| Titanium oxide (Trademark: "CR-EL" , made by Ishihara Sangyo Kaisha, Ltd.) | 1750 |
| Alkyd resin (Trademark: "Beckosol 1307-60-EL:, made by Dainippon Ink & Chemicals, Incorporated) | 350 |
| Melamine resin (Trademark: "Super Beckamine G821-60", made by Dainippon Ink & Chemicals, Incorporated) | 233 |
| Methyl ethyl ketone | 1200 |

The above dispersion was diluted with a mixture with the following formulation, whereby the above-mentioned undercoat layer formation liquid was prepared:

| | Parts by Weight |
|---|---|
| Polyaklylene glycol diester (Trademark: "Ionet DS-300", made by Sanyo Chemical Industries, Ltd.) | 87 |
| Methyl ethyl ketone | 800 |
| Isopropanol | 667 |

EXAMPLE 39

The procedure for the fabrication of the electrophotographic photoconductors Nos. 1-1 and 1-2 in Example 1 was repeated except that the formulation of the charge generation layer was changed to the same formulation of the charge generation layer as in Example 30, and that an undercoat layer with a thickness of 1 μwas provided between the aluminum drum serving as electroconductive support and the charge generation layer, which was formed by coating an undercoat layer formation liquid with the following formulation on the aluminum drum by immersion coating, drying and curing the coated liquid at 130° C. for 30 minutes, whereby electrophotographic photoconductors Nos. 39-1 and 39-2 of the present invention were fabricated:

[Preparation of Undercoat Layer Formation Liquid]

A mixture of the following components was dispersed in a ball mill for 36 hours:

| | Parts by Weight |
|---|---|
| Zirconium oxide (made by Furuuchi Chemical Corporation) | 1800 |
| Alkyd resin (Trademark: "Beckosol 1307-60-EL", made by Dainippon Ink & Chemicals, Incorporated) | 300 |
| Melamine resin (Trademark: "Super Beckamine G821-60", made by Dainippon Ink & Chemicals, Incorporated) | 200 |
| Methyl ethyl ketone | 1200 |

The above dispersion was then diluted with a mixed solvent with the following formulation, whereby the above undercoat layer formation liquid was prepared:

| | Parts by Weight |
|---|---|
| Polyaklylene glycol diester (Trademark: "Ionet DS-400", made by Sanyo Chemical Industries, Ltd.) | 35 |
| Methyl ethyl ketone | 800 |
| Methanol | 700 |

EXAMPLE 40

The procedure for the fabrication of the electrophotographic photoconductors Nos. 11-1 and 11-2 in Example 11 was repeated except that the formulation of the charge generation layer was changed to the same formulation of the charge generation layer as in Example 30, and that an undercoat layer with a thickness of 5 μm was provided between the aluminum drum serving as electroconductive support and the charge generation layer, which was formed by coating an undercoat layer formation liquid with the following formulation on the aluminum drum by immersion coating, drying and curing the coated liquid at 130° C. for 30 minutes, whereby electrophotographic photoconductors Nos. 40-1 and 40-2 of the present invention were fabricated:

[Preparation of Undercoat Layer Formation Liquid]

A mixture of the following components was dispersed in a ball mill for 36 hours:

| | Parts by Weight |
|---|---|
| Tin oxide (made by Mitsubishi Materials Corporation) | 2100 |
| Alkyd resin (Trademark: "Beckosol 1307-60-EL", made by Dainippon Ink & Chemicals, Incorporated) | 350 |
| Melamine resin (Trademark: "Super Beckamine G821-60", made by Dainippon Ink & Chemicals, Incorporated) | 233 |
| Methyl ethyl ketone | 1300 |

The above dispersion was diluted with a mixture of the following components, whereby the above undercoat layer formation liquid was prepared:

| | Parts by Weight |
|---|---|
| Polyalkylene glycol monoether (Trademark: "Emulmin L380", made by Sanyo Chemical Industries, Ltd.) | 35 |
| Methyl ethyl ketone | 400 |
| Isopropanol | 600 |

EXAMPLE 41

The procedure for the fabrication of the electrophotographic photoconductors Nos. 10-1 and 10-2 in Example 10 was repeated except that the electroconductive support employed in Example 10 was replaced by an aluminum-deposited seamless belt-shaped polyimide film with a diameter of 80 mm, the formulation of the charge generation layer was changed to the same formulation of the charge generation layer as in Example 30, and that an undercoat layer with a thickness of 5 μm was provided between the aluminum-deposited polyimide film and the charge generation layer, which was formed by coating an undercoat layer formation liquid with the following formulation on the aluminum-deposited polyimide film by immersion coating, drying and curing the coated liquid at 100° C. for 50 minutes, whereby electrophotographic photoconductors Nos. 41-1 and 41-2 of the present invention were fabricated:

[Preparation of Undercoat Layer Formation Liquid]

A mixture of the following components was dispersed in a ball mill for 12 hours:

| | Parts by Weight |
|---|---|
| Indium oxide (made by Mitsubishi Materials Corporation) | 2100 |

-continued

| | Parts by Weight |
|---|---|
| Alcohol-soluble nylon (Trademark: "Amilan CM-8000", made by Toray Industries, Inc.) | 350 |
| Methanol | 1450 |
| Polyalkylene glycol (Trademark: "Terathane T-2900", made by Du Pont de Nemours, E. I. & Co.) | 35 |

The above dispersion was diluted with a mixed solvent with the following formulation, whereby the above undercoat layer formation liquid was prepared:

| | Parts by Weight |
|---|---|
| Methanol | 500 |
| n-butanol | 600 |

EXAMPLE 42

The procedure for the fabrication of the electrophotographic photoconductors Nos. 4-1 and 4-2 in Example 4 was repeated except that the electroconductive support employed in Example 10 was replaced by a Hastelloy-deposited seamless belt-shaped polyimide film with a diameter of 80 mm, the formulation of the charge generation layer was changed to the same formulation of the charge generation layer as in Example 29, and that an undercoat layer with a thickness of 3 μm was provided between the Hastelloy-deposited polyimide film and the charge generation layer, which was formed by coating an undercoat layer formation liquid with the following formulation on the Hastelloy-deposited polyimide film by immersion coating, drying and curing the coated liquid at 100° C. for 50 minutes, whereby electrophotographic photoconductors Nos. 42-1 and 42-2 of the present invention were fabricated:

[Preparation of Undercoat Layer Formation Liquid]

A mixture of the following component was dispersed in a ball mill for 12 hours:

| | Parts by Weight |
|---|---|
| Titanium oxide (Trademark: "TA-300", made by Ishihara Sangyo Kaisha, Ltd.) | 1800 |
| Alcohol-soluble nylon (Trademark: "Amilan CM-8000", made by Toray Industries, Inc.) | 300 |
| Methanol | 1400 |

The above dispersion was diluted with a mixture of the following components, whereby the above undercoat layer formation liquid was prepared:

| | Parts by Weight |
|---|---|
| Polyalkylene glycol (Trademark: "Terathane T-2900", made by Du Pont de Nemours, E. I. & Co.) | 30 |

-continued

| | Parts by Weight |
|---|---|
| Methanol | 800 |
| n-butanol | 700 |

EXAMPLE 43

The procedure for the fabrication of the electrophotographic photoconductors Nos. 13-1 and 13-2 in Example 13 was repeated except that the formulation of the charge generation layer in Example 13 was changed to the same formulation of the charge generation layer as in Example 35, and that an undercoat layer with a thickness of 5 μm was provided between the aluminum drum and the charge generation layer, which was formed by coating and drying the same undercoat layer formation liquid as employed in Example 32 under the same conditions as in Example 32, whereby electrophotographic photoconductors Nos. 43-1 and 43-2 of the present invention were fabricated.

EXAMPLE 44

The procedure for the fabrication of the electrophotographic photoconductors Nos. 15-1 and 15-2 in Example 15 was repeated except that the formulation of the charge generation layer in Example 15 was changed to the same formulation of the charge generation layer as in Example 34, and that an undercoat layer with a thickness of 5 μm was provided between the aluminum drum and the charge generation layer, which was formed by coating and drying an undercoat layer formation liquid which was the same as the undercoat layer formation liquid as employed in Example 37 except that 40 parts by weight of the copolymer of ethylene glycol and i-propylene glycol (Trademark: "Newpol PE68", Sanyo Chemical Industries, Ltd.) employed in Example 37 were replaced by 160 parts by weight of polyalkylene glycol diester (Trademark: "Ionet DS-400", made by Sanyo Chemical Industries, Ltd.), whereby electrophotographic photoconductors Nos. 44-1 and 44-2 of the present invention were fabricated.

EXAMPLE 45

The procedure for the fabrication of the electrophotographic photoconductors Nos. 12-1 and 12-2 in Example 12 was repeated except that the formulation of the charge generation layer in Example 12 was changed to the same formulation of the charge generation layer as in Example 30, whereby electrophotographic photoconductors Nos. 45-1 and 45-2 of the present invention were fabricated.

EXAMPLE 46

The procedure for the fabrication of the electrophotographic photoconductors Nos. 5-1 and 5-2 in Example 5 was repeated except that the formulation of the charge generation layer in Example 5 was changed to the same formulation of the charge generation layer as in Example 30, and that an undercoat layer with a thickness of 5 μm was provided between the aluminum drum and the charge generation layer, which was formed by coating and drying an undercoat layer formation liquid which was the same as the undercoat layer formation liquid as employed in Example 32 except that 18 parts by weight of the polyalkylene glycol were replaced by 18 parts by weight of dibenzo-18-crown-6-ether, whereby electrophotographic photoconductors Nos. 46-1 and 46-2 of the present invention were fabricated.

EXAMPLE 47

The procedure for the fabrication of the electrophotographic photoconductors Nos. 17-1 and 17-2 in Example 17 was repeated except that the formulation of the charge generation layer in Example 17 was changed to the same formulation of the charge generation layer as in Example 29, and that an undercoat layer with a thickness of 5 μm was provided between the aluminum drum and the charge generation layer, which was formed by coating and drying an undercoat layer formation liquid which was the same as the undercoat layer formation liquid as employed in Example 41 except that 35 parts by weight of the polyalkylene glycol were replaced by 17.5 parts by weight of tribenzo-18-crown-6-ether, whereby electrophotographic photoconductors Nos. 47-1 and 47-2 of the present invention were fabricated.

EXAMPLE 48

The procedure for the fabrication of the electrophotographic photoconductors Nos. 22-1 and 22-2 in Example 22 was repeated except that the formulation of the charge generation layer in Example 22 was changed to the same formulation of the charge generation layer as in Example 30, and that an undercoat layer with a thickness of 3 μm was provided between the aluminum drum and the charge generation layer, which was formed by coating and drying an undercoat layer formation liquid which was the same as the undercoat layer formation liquid as employed in Example 34 except that 36 parts by weight of the copolymer of ethylene glycol and i-propylene glycol (Trademark: "Newpol PE68", Sanyo Chemical Industries, Ltd.) were replaced by 22.5 parts by weight of dibenzo-18-crown-6-ether, whereby electrophotographic photoconductors Nos. 48-1 and 48-2 of the present invention were fabricated.

EXAMPLE 49

The procedure for the fabrication of the electrophotographic photoconductors Nos. 11-1 and 11-2 in Example 11 was repeated except that the formulation of the charge generation layer in Example 11 was changed to the same formulation of the charge generation layer as in Example 30, and that an undercoat layer with a thickness of 1 μm was provided between the aluminum drum and the charge generation layer, which was formed by coating and drying an undercoat layer formation liquid which was the same as the undercoat layer formation liquid as employed in Example 35 except that 45 parts by weight of the polyalkylene glycol diester employed in Example 5 were replaced by 15 parts by weight of tribenzo-18-crown-6-ether, whereby electrophotographic photoconductors Nos. 49-1 and 49-2 of the present invention were fabricated.

EXAMPLE 50

The procedure for the fabrication of the electrophotographic photoconductors Nos. 6-1 and 6-2 in Example 6 was repeated except that the formulation of the charge generation layer in Example 6 was changed to the same formulation of the charge generation layer as in Example 29, and that an undercoat layer with a thickness of 0.3 μm was provided between the aluminum drum and the charge generation layer, which was formed by coating and drying an undercoat layer formation liquid which was the same as the undercoat layer formation liquid as employed in Example 26 except that 3.6 parts by weight of dibenzo-18-crown-6-ether were added thereto, whereby electrophotographic photoconductors Nos. 50-1 and 50-2 of the present invention were fabricated.

EXAMPLE 51

The procedure for the fabrication of the electrophotographic photoconductors Nos. 38-1 and 38-2 in Example 38 was repeated except that the formulation of the charge generation layer in Example 38 was changed to the same formulation of the charge generation layer as in Example 29, and that an undercoat layer with a thickness of 0.5 μm was provided between the aluminum drum and the charge generation layer, which was formed by coating and drying an undercoat layer formation liquid which was the same as the undercoat layer formation liquid as employed in Example 25 except that 4.8 parts by weight of tribenzo-18-crown-6-ether were added thereto, whereby electrophotographic photoconductors Nos. 51-1 and 51-2 of the present invention were fabricated.

COMPARATIVE EXAMPLE 6

The procedure for the fabrication of the electrophotographic photoconductors Nos. 29-1 and 29-2 in Example 29 was repeated except that the α-tocopherol was eliminated from the charge transport layer in Example 29, whereby comparative electrophotographic photoconductors Nos. 6-1 and 6-2 were fabricated.

COMPARATIVE EXAMPLE 7

The procedure for the fabrication of the electrophotographic photoconductors Nos. 29-1 and 29-2 in Example 29 was repeated except that the polyalkylene glycol was eliminated from the undercoat layer in Example 29, whereby comparative electrophotographic photoconductors Nos. 7-1 and 7-2 were fabricated.

COMPARATIVE EXAMPLE 8

The procedure for the fabrication of the electrophotographic photoconductors Nos. 32-1 and 32-2 in Example 32 was repeated except that the 2,6-di-tert-butyl-4-methylphenol was eliminated from the charge transport layer in Example 32, whereby comparative electrophotographic photoconductors Nos. 8-1 and 8-2 were fabricated.

COMPARATIVE EXAMPLE 9

The procedure for the fabrication of the electrophotographic photoconductors Nos. 32-1 and 32-2 in Example 32 was repeated except that the polyalkylene glycol was eliminated from the undercoat layer in Example 32, whereby comparative electrophotographic photoconductors Nos. 9-1 and 9-2 were fabricated.

The thus fabricated electrophotographic photoconductors Nos. 2-1, 2-2 to 51-1, 51-2 of the present invention and comparative electrophotographic photoconductors Nos. 1-1, 1-2 to 9-1, 92 were evaluated in the same manner as in Example 1. The results are shown in TABLE 1.

TABLE 1

| | CTL was formed immediately after the preparation of CTL formation liquid therefor | | | | | | | | CTL was formed by use of CTL formation liquid circulated for 20 days | | | | | | | |
|---|---|---|---|---|---|---|---|---|---|---|---|---|---|---|---|---|
| | Before Fatigue Test | | | | After Fatigue Test | | | | Before Fatigue Test | | | | After Fatigue Test | | | |
| | $V_1$ (V) | DD | $V_r$ (V) | $E_{1/2}$ (lux · sec) | $V_1$ (V) | DD | $V_r$ (V) | $E_{1/2}$ (lux · sec) | $V_1$ (V) | DD | $V_r$ (V) | $E_{1/2}$ (lux · sec) | $V_1$ (V) | DD | $V_r$ (V) | $E_{1/2}$ (lux · sec) |
| Ex. 1 | −300 | 0.95 | 0 | 0.85 | −290 | 0.80 | −38 | 0.87 | −303 | 0.95 | 0 | 0.86 | −287 | 0.81 | −38 | 0.87 |
| Ex. 2 | −312 | 0.93 | 0 | 0.81 | −292 | 0.81 | −36 | 0.83 | −306 | 0.93 | 0 | 0.81 | −290 | 0.80 | −38 | 0.83 |
| Ex. 3 | −305 | 0.93 | 0 | 0.82 | −288 | 0.80 | −38 | 0.84 | −301 | 0.93 | 0 | 0.82 | <285 | 0.80 | −38 | 0.84 |
| Ex. 4 | −302 | 0.92 | 0 | 0.92 | −284 | 0.80 | −38 | 0.94 | −306 | 0.92 | 0 | 0.92 | −292 | 0.88 | −38 | 0.94 |
| Ex. 5 | −310 | 0.95 | 0 | 0.85 | −294 | 0.88 | −26 | 0.87 | −306 | 0.95 | 0 | 0.85 | −268 | 0.88 | −26 | 0.87 |
| Ex. 6 | −308 | 0.95 | 0 | 0.85 | −294 | 0.90 | −26 | 0.87 | −306 | 0.95 | 0 | 0.85 | −290 | 0.89 | −26 | 0.87 |
| Ex. 7 | −296 | 0.94 | 0 | 0.78 | −282 | 0.90 | −20 | 0.79 | −302 | 0.95 | 0 | 0.78 | −286 | 0.90 | −20 | 0.79 |
| Ex. 8 | −298 | 0.93 | 0 | 0.85 | −206 | 0.88 | −24 | 0.87 | −296 | 0.92 | 0 | 0.85 | −280 | 0.87 | −26 | 0.87 |
| Ex. 9 | −302 | 0.94 | 0 | 0.92 | −288 | 0.88 | −24 | 0.94 | −298 | 0.95 | 0 | 0.92 | −286 | 0.88 | −24 | 0.94 |
| Ex. 10 | −306 | 0.93 | 0 | 0.82 | −285 | 0.87 | −26 | 0.84 | −304 | 0.93 | 0 | 0.82 | −290 | 0.86 | −26 | 0.84 |
| Ex. 11 | −301 | 0.93 | 0 | 0.85 | −288 | 0.88 | −24 | 0.87 | −305 | 0.93 | 0 | 0.85 | −288 | 0.88 | −26 | 0.87 |
| Ex. 12 | −296 | 0.92 | 0 | 1.0 | −280 | 0.86 | −26 | 1.0 | −304 | 0.93 | 0 | 1.0 | −292 | 0.86 | −26 | 1.0 |
| Ex. 13 | −310 | 0.94 | 0 | 0.95 | −296 | 0.89 | −20 | 0.97 | −306 | 0.93 | 0 | 0.95 | −296 | 0.89 | −20 | 0.97 |
| Ex. 14 | −302 | 0.93 | 0 | 0.80 | −286 | 0.87 | −24 | 0.62 | −294 | 0.92 | 0 | 0.80 | −280 | 0.87 | −25 | 0.82 |
| Ex. 15 | −296 | 0.93 | 0 | 0.87 | −282 | 0.88 | −24 | 0.89 | −304 | 0.93 | 0 | 0.87 | −268 | 0.87 | −24 | 0.89 |
| Ex. 16 | −306 | 0.93 | 0 | 0.60 | −290 | 0.68 | −26 | 0.62 | −302 | 0.93 | 0 | 0.60 | −294 | 0.88 | −26 | 0.62 |
| Ex. 17 | −292 | 0.92 | 0 | 0.82 | −277 | 0.80 | −36 | 0.84 | −290 | 0.92 | 0 | 0.82 | −274 | 0.81 | −36 | 0.84 |
| Ex. 18 | −298 | 0.92 | 0 | 0.85 | −280 | 0.80 | −38 | 0.87 | −296 | 0.92 | 0 | 0.85 | −282 | 0.88 | −38 | 0.87 |
| Ex. 19 | −302 | 0.93 | 0 | 0.85 | −286 | 0.86 | −26 | 0.87 | −306 | 0.93 | 0 | 0.85 | −290 | 0.86 | −26 | 0.87 |
| Ex. 20 | −306 | 0.93 | 0 | 0.92 | −290 | 0.87 | −28 | 0.94 | −302 | 0.93 | 0 | 0.92 | −290 | 0.86 | −28 | 0.94 |
| Ex. 21 | −300 | 0.94 | 0 | 0.85 | −282 | 0.86 | −26 | 0.87 | −300 | 0.93 | 0 | 0.85 | −286 | 0.86 | −28 | 0.87 |
| Ex. 22 | −294 | 0.93 | 0 | 0.82 | −278 | 0.87 | −28 | 0.84 | −298 | 0.94 | 0 | 0.82 | −280 | 0.87 | −28 | 0.84 |
| Ex. 23 | −290 | 0.93 | 0 | 0.85 | −280 | 0.87 | −26 | 0.87 | −292 | 0.93 | 0 | 0.85 | −276 | 0.86 | −26 | 0.87 |
| Ex. 24 | −312 | 0.93 | 0 | 0.82 | −294 | 0.86 | −26 | 0.84 | −308 | 0.92 | 0 | 0.82 | −294 | 0.86 | −28 | 0.84 |
| Ex. 25 | −310 | 0.95 | −4 | 0.85 | −302 | 0.83 | −38 | 0.87 | −312 | 0.95 | −4 | 0.85 | −306 | 0.83 | −38 | 0.87 |
| Ex. 26 | −315 | 0.95 | −4 | 0.85 | −395 | 0.88 | −30 | 0.87 | −312 | 0.95 | −4 | 0.85 | −304 | 0.88 | −30 | 0.89 |
| Ex. 27 | −312 | 0.95 | −4 | 0.95 | −300 | 0.89 | −26 | 0.97 | −308 | 0.94 | −4 | 0.95 | −296 | 0.89 | −26 | 0.97 |
| Ex. 32 | −318 | 0.93 | 0 | 0.95 | −298 | 0.87 | −10 | 0.95 | −306 | 0.93 | 0 | 0.95 | −298 | 0.87 | −10 | 0.95 |
| Ex. 33 | −306 | 0.92 | 0 | 0.78 | −296 | 0.86 | −6 | 0.78 | −308 | 0.93 | 0 | 0.78 | −294 | 0.86 | −6 | 0.78 |
| Ex. 34 | −312 | 0.94 | −2 | 0.80 | −306 | 0.88 | −12 | 0.80 | −310 | 0.93 | −2 | 0.80 | −306 | 0.88 | −12 | 0.80 |
| Ex. 35 | −315 | 0.95 | −4 | 0.60 | −302 | 0.89 | −20 | 0.61 | −310 | 0.94 | −4 | 0.60 | −296 | 0.88 | −18 | 0.61 |
| Ex. 36 | −308 | 0.93 | 0 | 0.78 | −292 | 0.86 | −10 | 0.78 | −304 | 0.93 | 0 | 0.78 | −288 | 0.86 | −10 | 0.78 |
| Ex. 37 | −306 | 0.93 | 0 | 0.67 | −290 | 0.87 | −6 | 0.67 | −308 | 0.94 | 0 | 0.67 | −296 | 0.87 | −6 | 0.67 |
| Ex. 38 | −314 | 0.93 | −2 | 0.57 | −308 | 0.48 | −10 | 0.67 | −315 | 0.94 | −2 | 0.57 | −306 | 0.88 | −10 | 0.57 |
| Ex. 39 | −310 | 0.94 | −4 | 0.95 | −294 | 0.83 | −36 | 0.99 | −306 | 0.94 | −4 | 0.95 | −292 | 0.83 | −34 | 0.99 |
| Ex. 40 | −306 | 0.93 | 0 | 0.95 | −290 | 0.87 | −10 | 0.95 | −300 | 0.93 | 0 | 0.95 | −286 | 0.87 | −10 | 0.95 |
| Ex. 41 | −310 | 0.92 | 0 | 0.92 | −292 | 0.86 | −6 | 0.92 | −306 | 0.92 | 0 | 0.92 | −290 | 0.86 | −6 | 0.92 |
| Ex. 42 | −306 | 0.94 | −2 | 0.92 | −292 | 0.83 | −36 | 0.96 | −304 | 0.93 | −2 | 0.92 | −294 | 0.83 | −38 | 0.95 |
| Ex. 43 | −302 | 0.94 | 0 | 0.60 | −294 | 0.88 | −10 | 0.60 | −306 | 0.93 | 0 | 0.60 | −292 | 0.87 | −10 | 0.60 |
| Ex. 44 | −308 | 0.93 | 0 | 0.87 | −298 | 0.87 | −6 | 0.87 | −304 | 0.94 | 0 | 0.67 | −296 | 0.87 | −6 | 0.87 |
| Ex. 45 | −308 | 0.93 | −2 | 1.0 | −294 | 0.88 | −12 | 1.0 | −312 | 0.94 | −2 | 1.0 | −304 | 0.89 | −12 | 1.0 |
| Ex. 46 | −302 | 0.93 | 0 | 0.92 | −288 | 0.86 | −10 | 0.92 | −308 | 0.93 | 0 | 0.92 | −296 | 0.86 | −10 | 0.92 |
| Ex. 47 | −306 | 0.92 | 0 | 0.82 | −296 | 0.82 | −32 | 0.86 | −306 | 0.92 | 0 | 0.82 | −294 | 0.81 | −36 | 0.86 |
| Ex. 48 | −306 | 0.93 | −2 | 0.89 | −290 | 0.86 | −12 | 0.89 | −310 | 0.92 | −2 | 0.89 | −296 | 0.86 | −12 | 0.89 |
| Ex. 49 | −312 | 0.93 | −4 | 0.92 | −296 | 0.88 | −20 | 0.93 | −310 | 0.94 | −4 | 0.92 | −296 | 0.88 | −20 | 0.93 |
| Ex. 28 | −310 | 0.94 | −4 | 0.82 | −302 | 0.87 | −28 | 0.84 | −306 | 0.95 | −4 | 0.82 | −304 | 0.87 | −28 | 0.84 |
| Comp. Ex. 1 | −208 | 0.78 | 0 | 0.84 | −10 | 0.05 | −15 | 0.80 | — | — | — | — | — | — | — | — |
| Comp. Ex. 2 | −270 | 0.85 | −4 | 0.85 | −82 | 0.27 | −28 | 0.84 | — | — | — | — | — | — | — | — |
| Comp. Ex. 3 | −296 | 0.93 | 0 | 0.84 | −192 | 0.60 | −25 | 0.85 | −298 | 0.93 | 0 | 0.84 | −112 | 0.48 | −24 | 0.86 |
| Comp. Ex. 4 | −243 | 0.81 | 0 | 0.84 | −62 | 0.38 | −30 | 0.86 | — | — | — | — | — | — | — | — |
| Comp. Ex. 5 | −280 | 0.82 | −2 | 0.87 | −114 | 0.50 | −62 | 0.92 | −276 | 0.82 | −2 | 0.87 | −98 | 0.48 | −60 | 0.92 |
| Ex. 29 | −310 | 0.93 | −4 | 0.82 | −396 | 0.81 | −38 | 0.84 | −308 | 0.93 | −4 | 0.82 | −298 | 0.80 | −38 | 0.84 |
| Ex. 30 | −314 | 0.93 | −4 | 1.0 | −388 | 0.81 | −36 | 1.0 | −308 | 0.93 | −4 | 1.0 | −308 | 0.81 | −36 | 1.0 |
| Ex. 31 | −312 | 0.93 | −4 | 0.92 | −304 | 0.87 | −30 | 0.94 | −305 | 0.94 | −4 | 0.92 | −294 | 0.87 | −28 | 0.94 |
| Ex. 50 | −308 | 0.93 | −4 | 0.86 | −298 | 0.87 | −38 | 0.87 | −308 | 0.93 | −4 | 0.85 | −294 | 0.87 | −32 | 0.87 |
| Ex. 51 | −312 | 0.94 | −4 | 0.82 | −298 | 0.86 | −38 | 0.85 | −310 | 0.94 | −4 | 0.82 | −300 | 0.89 | −30 | 0.85 |
| Comp. Ex. 6 | −308 | 0.92 | −4 | 0.82 | −188 | 0.62 | −27 | 0.84 | −304 | 0.93 | −4 | 0.82 | −120 | 0.48 | −28 | 0.84 |
| Comp. Ex. 7 | −230 | 0.77 | −4 | 0.81 | −30 | 0.15 | −38 | 0.82 | — | — | — | — | — | — | — | — |
| Comp. Ex. 8 | −306 | 0.92 | 0 | 0.95 | −192 | 0.56 | −10 | 0.95 | −302 | 0.92 | 0 | 0.95 | −110 | 0.44 | −10 | 0.93 |
| Comp. Ex. 9 | −220 | 0.75 | 0 | 0.94 | −45 | 0.18 | −6 | 0.91 | — | — | — | — | — | — | — | — |

* Mark "—" in the above denotes that no evaluation was made since the prepared CTL considerably deteriorated.

According to the present invention, there can be obtained electrophotographic photoconductors without the reduction of the chargeability thereof and with a minimum increase in the residual potential thereof even when used repeatedly.

What is claimed is:

1. A layered electrophotographic photoconductor comprising:

an electroconductive support; and a photoconductive layer formed thereon, which photoconductive layer comprises a charge generation layer and a charge transport layer, which are overlaid, with said charge generation layer comprising a polyalkylene glycol and/or an ester or ether thereof, and/or a crown ether, and said charge transport layer comprising an anti-oxidant.

2. The layered electrophotographic photoconductor as claimed in claim 1, wherein said antioxidant is a t-butylated phenolic compound.

3. The layered electrophotographic photoconductor as claimed in claim 1, wherein said antioxidant is an organic phosphorous ester compound.

4. The layered electrophotographic photoconductor as claimed in claim 1, wherein said antioxidant is an organic sulfur compound.

5. A layered electrophotographic photoconductor comprising:

an electroconductive support; and a photoconductive layer formed thereon, which photoconductive layer comprises a charge generation layer and a charge transport layer, which are overlaid; and an undercoat layer which is interposed between said electroconductive support and said photoconductive layer, with said undercoat layer comprising a polyalkylene glycol and/or an ester or ether thereof, and/or a crown ether, and said charge transport layer comprising an anti-oxidant.

6. The layered electrophotographic photoconductor as claimed in claim 5, wherein said antioxidant is a t-butylated phenolic compound.

7. The layered electrophotographic photoconductor as claimed in claim 5, wherein said antioxidant is an organic phosphorous compound.

8. The layered electrophotographic photoconductor as claimed in claim 5, wherein said antioxidant is an organic sulfur compound.

9. The layered electrophotographic photoconductor as claimed in claim 5, wherein said undercoat layer further comprises a metallic oxide.

* * * * *

UNITED STATES PATENT AND TRADEMARK OFFICE

CERTIFICATE OF CORRECTION

PATENT NO. : 5,670,284
DATED : SEPTEMBER 23, 1997
INVENTOR(S) : HIROYUKI KISHI ET AL

It is certified that error appears in the above-identified patent and that said Letters Patent is hereby corrected as shown below:

Column 1, line 58, "Applications" should read --Application--;
line 61, "Applications" should read --Application--;
line 64, "Applications" should read --Application--;
line 67, "Applications" should read --Application--.

Column 3, line 34, "also employed" should read --also be employed--.

Column 7, line 14, "γ-tocopherol, Naphthol AS," should read --γ-tocopherol, δ-tocopherol, Naphthol AS,--

Column 10, line 59, "plastics" should read --plastic--.

Column 11, line 12, "power" should read --powder--;
line 19, "regions" should read --resins--.

Column 16, line 44, "liquid" should read --light--.

Column 17, line 7, "with in" should read --within--;
line 19, "evaluation" should read --evaluated--.

Column 19, line 32, "DC-300"," should read --DS-300",--;
line 36, "photo-conductors" should read --photoconductors--.

Column 20, line 21, "photo-conductors" should read --photoconductors--.

UNITED STATES PATENT AND TRADEMARK OFFICE

CERTIFICATE OF CORRECTION

PATENT NO. : 5,670,284
DATED : SEPTEMBER 23, 1997
INVENTOR(S) : HIROYUKI KISHI ET AL

It is certified that error appears in the above-identified patent and that said Letters Patent is hereby corrected as shown below:

Column 43, line 57, insert
--Example 32
The procedure for the fabrication of the electro- --

Column 45, line 57, ""XF-50"" should read --"KF-50"--.

Column 47, line 36, "prepared generation" should read --prepared charge generation--.

Column 48, line 3, "electrophotographic No. 34-2" should read --electrophotographic photoconductor No. 34-2--.

Column 49, line 57, insert --[Formulation of Undercoat Layer Formation Liquid]--.

Column 50, line 7, "756" should read --750--;
line 25, insert --[Preparation of Undercoat Layer Formation Liquid]--;
line 26, insert --A mixture of the following components was dispersed in a ball mill for 36 hours:--;
line 48, insert --EXAMPLE 38--.

Column 51, line 30, "1 $\mu$was" should read --1 $\mu$m was--.

UNITED STATES PATENT AND TRADEMARK OFFICE

CERTIFICATE OF CORRECTION

PATENT NO. : 5,670,284

DATED : SEPTEMBER 23, 1997

INVENTOR(S) : HIROYUKI KISHI ET AL

It is certified that error appears in the above-identified patent and that said Letters Patent is hereby corrected as shown below:

Column 56, line 61, "92" should read --9-2--.

Column 57, Ex. 8, sixth column, "-206" should read ---208--;
Ex. 14, ninth column, "0.62" should read --0.82--;
Ex. 16, seventh column, "0.68" should read --0.88--;
Ex. 24, eighth column, "-26" should read ---28--;
Ex. 26, sixth column, "-395" should read ---305--;
Ex. 37, second column, "-306" should read ---308--;
Ex. 38, seventh column, "0.48" should read --0.88--;
same line, ninth column, "0.67" should read --0.57--;
Ex. 40, second column, "-306" should read ---308--;
Comp. Ex. 3, ninth column, "0.85" should read --0.86--;
Ex. 29, sixth column, "-396" should read ---306--;
Ex. 30, sixth column, "-388" should read ---308--;
Ex. 50, fifth column, "0.86" should read --0.85--;
same line, eighth column, "-38" should read ---28--;
Ex. 51, seventh column, "0.86" should read --0.88--;
same line, eighth column, "-38" should read ---30--;
Comp. Ex. 8, second column, "-306" should read ---308--.

Column 58, Ex. 1, fourth column, "0.86" should read --0.85--;
Ex. 2, first column, "-306" should read ---308--;
Ex. 3, fifth column, "<285" should read ---285--;

UNITED STATES PATENT AND TRADEMARK OFFICE

CERTIFICATE OF CORRECTION

PATENT NO. : 5,670,284

DATED : SEPTEMBER 23, 1997

INVENTOR(S) : HIROYUKI KISHI ET AL

It is certified that error appears in the above-identified patent and that said Letters Patent is hereby corrected as shown below:

Ex. 4, first column, "-306" should read ---308--;
same line, sixth column, "0.88" should read --0.80--;
Ex. 5, fifth column, "-268" should read ---288--;
same line, sixth column, "0.88" should read --0.89--;
Ex. 6, seventh column, "-26" should read ---28--;
Ex. 15, fifth column, "-268" should read ---288--;
Ex. 18, sixth column, "0.88" should read --0.80--;
Ex. 19, first column, "-306" should read ---308--;
Ex. 44, fourth column, "0.67" should read --0.87--;
Ex. 28, first column, "-306" should read ---308--;
Ex. 30, fifth column, "-308" should read ---300--;
Ex. 31, first column, "-305" should read ---306--.

Signed and Sealed this

Twenty-first Day of July, 1998

*Attest:*

*Attesting Officer*

BRUCE LEHMAN

*Commissioner of Patents and Trademarks*